US005994046A

United States Patent [19]

Kawai

[11] Patent Number: 5,994,046

[45] Date of Patent: Nov. 30, 1999

[54] SILVER HALIDE COLOR PHOTOGRAPHIC LIGHT-SENSITIVE MATERIAL AND METHOD OF FORMING COLOR IMAGE USING THE SAME

[75] Inventor: Kiyoshi Kawai, Kanagawa, Japan

[73] Assignee: Fuji Photo Film Co., LTD., Ashigara, Japan

[21] Appl. No.: 08/873,403

[22] Filed: Jun. 11, 1997

[30] Foreign Application Priority Data

Jun. 11, 1997 [JP] Japan ..... 8-154622

[51] Int. Cl.[6] ..... G03C 1/08; G03C 7/26; G03C 7/32

[52] U.S. Cl. ..... 430/546; 430/558; 430/517; 430/567

[58] Field of Search ..... 430/558, 567, 430/546, 517

[56] References Cited

U.S. PATENT DOCUMENTS

| | | | |
|---|---|---|---|
| 5,356,764 | 10/1994 | Szajewski et al. | 430/567 |
| 5,547,826 | 8/1996 | Ito et al. | 430/558 |
| 5,736,299 | 4/1998 | Watanabe et al. | 430/558 |

*Primary Examiner*—Geraldine Letscher
*Attorney, Agent, or Firm*—Burns, Doane, Swecker & Mathis, LLP

[57] ABSTRACT

A silver halide color photographic light-sensitive material comprising a support having thereon photographic constituent layers comprising at least three silver halide emulsion layers each having a spectral sensitivity different from one another and containing yellow, magenta and cyan color forming couplers, respectively and a light-insensitive hydrophilic colloid layer, wherein the cyan color forming coupler is at least one dye forming coupler represented by the formula (I) shown below, at least one of the silver halide emulsion layers containing the cyan color forming coupler contains a silver halide emulsion composed of high silver chloride content grains having a silver chloride content of 80 mol % or more, and the high silver chloride content grains are tabular silver halide grains having (100) faces as major faces:

(I)

wherein $R_1$, $R_2$, $R_3$, $R_4$ and $R_5$ each represents a hydrogen atom or a substituent; Z represents a non-metallic atomic group necessary for forming a ring, which may be substituted; X represents a heterocyclic group, a substituted amino group or an aryl group; Y represents a hydrogen atom or a substituent; and $R_6$ represents a substituent.

The silver halide color photographic light-sensitive material is rapidly processable, has less dependence on processing conditions and provides a color image having excellent image quality and sharpness. It is also suitable for scanning exposure using a semiconductor laser as a light source. A method of forming a color image comprising subjecting the silver halide color photographic light-sensitive material to scanning exposure is also disclosed.

33 Claims, No Drawings

SILVER HALIDE COLOR PHOTOGRAPHIC LIGHT-SENSITIVE MATERIAL AND METHOD OF FORMING COLOR IMAGE USING THE SAME

FIELD OF THE INVENTION

The present invention relates to a silver halide color photographic light-sensitive material. More particularly, it relates to a silver halide color photographic light-sensitive material which is excellent in rapid processing suitability and has less dependence on processing conditions.

BACKGROUND OF THE INVENTION

Recently, various electronic image-forming means have been developed and the image qualities thereof have been compared with those of silver halide photographic light-sensitive materials. Also, as a result of the comparison, the high image quality and the easiness of the silver halide photographic light-sensitive material have been newly recognized. Accordingly, it has been investigated to use the silver halide color photographic light-sensitive material not only for a printing material of a photograph but also for a hard copy material of an electronic image. In such a circumstance, the investigations of improving the sharpness and the color reproducibility to further increase the image quality of the silver halide photographic light-sensitive material and improving the processing time and the processing method for achieving the easy and quick processing of the silver halide photographic light-sensitive material have been positively made. As to the increase in the easiness and quickening of processing, due to the progress in a simple and rapid development processing system as typified in a mini-laboratory system, printed photographs having an excellent image quality have been supplied relatively easily, in a short time and at a low cost. Furthermore, by using a silver halide emulsion having a high silver chloride content, it has been made to remarkably shorten the processing time and to restrain the processing fluctuation.

In addition to the shortening of processing time, it has been also investigated actively to reduce a replenishment rate of processing solution, resulting in decreasing the amount of waste solution to the extent of zero in view of improvement in handling and consideration to environment. In such a case, fluctuation on the capacity of photographic light-sensitive material due to the degradation of processing solution is the largest problem.

Various investigations have been made in order to control the fluctuation on the capacity of photographic light-sensitive material due to the degradation of processing solution. Those are roughly classified into (1) the improvement in light-sensitive silver halide grains, (2) the reform of factors (for example, couplers, oils and color forming accelerators) which dominate the coupling reaction of coupler with the oxidation product of a developing agent formed upon development, and (3) the elimination of substances which dissolve out from the photographic light-sensitive material during development and accumulate in the developer to cause the processing fluctuation or the conversion of the substances into those which have no influence on the developer.

Although these means of (1), (2) and (3) are individually effective, it is rarely the case that the greater effect is obtained by the combination of these means since these means have their optimum conditions, respectively, to exert their influence.

For instance, tabular silver halide grains of a high silver chloride content such as those having a silver chloride content of 80 mol % or more, which have (100) faces as major faces have the feature in that their developing speed is high in comparison with conventional cubic grains. However, they have the very large processing fluctuation as described above, and it is hard to control the processing fluctuation, even when they are used in combination with couplers which are able to restrain the processing fluctuation on conventional cubic silver halide grains.

Also, it has been found that water-soluble dyes which are conventionally incorporated into the silver halide photographic light-sensitive material for the purpose of improving sharpness thereof accumulate in the processing solution and cause severe density fluctuation to the tabular silver halide grains.

In addition, these problems are notable in case of effecting short exposure of high illumination intensity using a light source such as a laser.

SUMMARY OF THE INVENTION

Therefore, an object of the present invention is to provide a silver halide color photographic light-sensitive material having a high silver chloride content capable of providing rapidly a color photograph having a high image quality, which is rapidly processable and excellent in sharpness and with which the fluctuation of photographic capacity due to the exhaustion of processing solution (dependence on processing conditions) is restrained.

Anther object of the present invention is to provide a method of forming a color image using the silver halide color photographic light-sensitive material described above to provide rapidly a color photograph having a high image quality.

Other objects of the present invention will become apparent from the following detailed description and examples.

The above described objects of the present invention are accomplished with a silver halide color photographic light-sensitive material comprising a support having thereon photographic constituent layers comprising at least three silver halide emulsion layers each having a spectral sensitivity different from one another and containing yellow, magenta and cyan color forming couplers, respectively and a light-insensitive hydrophilic colloid layer, wherein the cyan color forming coupler is at least one dye forming coupler represented by the formula (I) shown below, at least one of the silver halide emulsion layers containing the cyan color forming coupler contains a silver halide emulsion composed of high silver chloride content grains having a silver chloride content of 80 mol % or more, and the high silver chloride content grains are tabular silver halide grains having (100) faces as major faces:

(I)

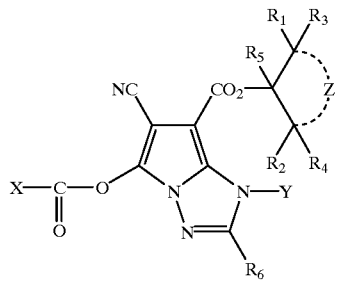

wherein $R_1$, $R_2$, $R_3$, $R_4$ and $R_5$ each represents a hydrogen atom or a substituent; Z represents a non-metallic atomic group necessary for forming a ring, which may be substituted; X represents a heterocyclic group, a substituted amino group or an aryl group; Y represents a hydrogen atom or a substituent; and $R_6$ represents a substituent.

The objects of the present invention are attained by a method of forming a color image comprising subjecting the silver halide color photographic light-sensitive material described above to a scanning exposure system for an exposure time of not more than $10^{-4}$ second per pixel.

DETAILED DESCRIPTION OF THE INVENTION

Preferred embodiments of the silver halide color photographic light-sensitive material and the method of forming a color image according to the present invention include the followings:

(1) the silver halide color photographic light-sensitive material as set forth above, wherein tabular grains having (100) faces as major faces and an aspect ratio (diameter/thickness) of 1.5 or more account for 10% or more of the total projected area of silver halide grains in the silver halide emulsion layer containing high silver chloride content grains, the tabular grains have at least one gap phase discontinuous in halogen composition in the nuclei thereof, and the gap is composed of a difference of from 10 to 100 mol % in $Cl^-$ content or $Br^-$ content and/or a difference of from 5 to 100 mol % in $I^-$ content, (2) the silver halide color photographic light-sensitive material as set forth in item (1), wherein the tabular grains have at least one gap phase discontinuous in halogen composition in the nuclei thereof, and the gas is composed of a difference of from 30 to 10 mol % in $Cl^-$ content or $Br^-$ content, (3) the silver halide color photographic light-sensitive material as set forth above or item (1) or (2), wherein at least one of the photographic constituent layers contains a water-soluble dye represented by the formula (IX) shown below in a molecular dispersion state of a monomolecule or a dimer:

(IX)

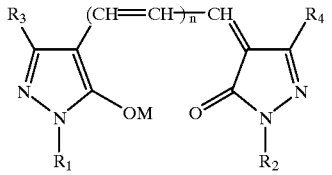

wherein $R_1$, $R_2$, $R_3$ and $R_4$ each represents a hydrogen atom or a substituent, provided that the total atomic weight of at least one of ($R_1$+$R_3$) and ($R_2$+$R_4$) is not more than 160; n represents 0, 1, or 2; and M represents a hydrogen atom or an alkali metal, (4) the silver halide color photographic light-sensitive material as set forth above, wherein $R_6$ represents a phenyl group having an aliphatic group in its 4-position and X represents a heterocyclic group in the dye forming coupler represented by the formula (I), and (5) the method of forming a color image as set forth above, wherein the silver halide color photographic light-sensitive material is each of those set forth in items (1), (2), (3) and (4).

Now, the present invention will be described in more detail below.

The cyan dye forming coupler represented by the general formula (I) which can be used in the present invention will be described in greater detail below.

In the formula (I), $R_1$ and $R_2$ each preferably represents an aliphatic group, for example, a straight chain or branched chain alkyl group having from 1 to 36 carbon atoms, an aralkyl group having from 7 to 36 carbon atoms, an alkenyl group having from 3 to 36 carbon atoms, an alkynyl group having from 3 to 36 carbon atoms, a cycloalkyl group having from 3 to 6 carbon atoms or a cycloalkenyl group having from 4 to 6 carbon atoms. Specific examples thereof include a methyl, ethyl, propyl, isopropyl, tert-butyl, tert-amyl, tert-octyl, tridecyl, cyclopentyl and cyclohexyl group. $R_3$, $R_4$ and $R_5$ each preferably represents a hydrogen atom or an aliphatic group. The aliphatic group for $R_3$, $R_4$ and $R_5$ is the same as that described for $R_1$ or $R_2$. More preferably, $R_3$, $R_4$ and $R_5$ each represents a hydrogen atom.

Z preferably represents a non-metallic atomic group necessary for forming a 5-membered to 8-membered ring which may be substituted. The ring may be saturated or unsaturated. Preferred non-metallic atom includes a nitrogen atom, an oxygen atom, a sulfur atom and a carbon atom. A carbon atom is more preferred.

Suitable examples of the ring formed together with Z include a cyclopentane ring, a cyclohexane ring, a cycloheptane ring, a cyclooctane ring, a cyclohexene ring, a piperazine ring, an oxane ring and a thione ring. The ring may be substituted with a substituent described for $R_3$ shown below.

The ring formed together with Z is preferably a cyclohexane ring which may be substituted. A cyclohexane ring substituted with an alkyl group having from 1 to 24 carbon atoms which may be substituted with a substituent described for $R_6$ shown below in its 4-position is particularly preferred.

The substituent represented by $R_6$ include, for example, a halogen atom (e.g., fluorine, chlorine, or bromine), an aliphatic group (preferably a straight chain or branched chain alkyl group having form 1 to 36 carbon atoms, an aralkyl group having form 7 to 36 carbon atoms, an alkenyl group having form 3 to 36 carbon atoms, an alkynyl group having form 3 to 36 carbon atoms, a cycloalkyl group having form 3 to 6 carbon atoms or a cycloalkenyl group having form 4 to 6 carbon atoms, specifically, e.g., methyl, ethyl, propyl, isopropyl, tert-butyl, tridecyl, tert-amyl, tert-octyl, 2-methanesulfonylethyl, 3-(3-pentadecylphenoxy)propyl, 3-{4-{2-[4-(4-hydroxyphenylsulfonyl)phenoxy]dodecanamido}-phenyl}propyl, 2-ethoxytridecyl, trifluoromethyl, cyclopentyl, or 3-(2,4-di-tert-amylphenoxy)propyl), an aryl group (preferably having from 6 to 36 carbon atoms, specifically, e.g., phenyl, 4-tert-butylphenyl, 2,4-di-tert-amylphenyl, 4-tetradecanamidophenyl, or 2-methoxyphenyl), a heterocyclic group (preferably having from 1 to 36 carbon atoms, specifically, e.g., 2-furyl, 2-thienyl, 2-pyrimidinyl, or 2-benzothiazolyl), a cyano group, a hydroxy group, a nitro group, a carboxy group, an amino group, an alkoxy group (preferably a straight chain, branched chain or cyclic alkoxy group having from 1 to 36 carbon atoms, specifically, e.g., methoxy, ethoxy, butoxy, 2-methoxyethoxy, 2-dodecyloxyethoxy, or 2-methanesulfonylethoxy), an aryloxy group (preferably having from 6 to 36 carbon atoms, specifically, e.g., phenoxy, 2-methylphenoxy, 4-tert-butylphenoxy, 3-nitrophenoxy, 3-tert-butyloxycarbamoylphenoxy, or 3-methoxycarbamoylphenoxy), an acylamino group (preferably having from 2 to 36 carbon atoms, specifically, e.g., acetamido, benzamido, tetradecaneamido, 2-(2,4-di-tert-amylphenoxy)butanamido, 4-(3-tert-butyl-4-hydroxyphenoxy) butanamido, or 2-[4-(4-hydroxyphenylsulfonyl)-phenoxy]decanamido), an alkylamino group (preferably having from 1 to 36 carbon atoms, specifically, e.g., methylamino, butylamino, dodecylamino, diethylamino, or methylbutylamino), an arylamino group (preferably having from 6 to 36 carbon atoms, specifically, e.g., phenylamino, 2-chioroanilino, 2-chloro-5-tetradecanamidoanilino, 2-chloro-5-dodecyloxycarbonylanilino, N-acetylanilino, or 2-chloro-5-[2-(3-tert-butyl-4-hydroxyphenoxy)dodecanamido]anilino), a ureido group (preferably having from 2 to 36 carbon atoms, specifically, e.g., phenylureido, methylureido, or N,N-dibutylureido), a sulfamoylamino group (preferably having from 1 to 36 carbon atoms, specifically, e.g., N,N-dipropylsulfamoylamino, or N-methyl-N-decylsulfamoylamino), an alkylthio group (preferably having form 1 to 36 carbon atoms, specifically, e.g., methylthio, octylthio, tetradecylthio, 2-phenoxyethylthio, 3-phenoxypropylthio, or 3-(4-tert-butylphenoxy) propylthio), an arylthio group (preferably having form 6 to 36 carbon atoms, specifically, e.g., phenylthio, 2-butoxy-5-tert-octylphenyl-thio, 3-pentadecylphenylthio, 2-carboxyphenylthio, or 4-tetradecanamidophenylthio), an alkoxycarbonylamino group (preferably having from 2 to 36 carbon atoms, specifically, e.g., methoxycarbonylamino, or tetradecyloxycarbonylamino), a sulfonamido group (preferably an alkyl- or aryl-sulfonamido group having from 1 to 36 carbon atoms, specifically, e.g., methanesulfonamido, hexadecanesulfonamido, butanesulfonamido, octanesulfonamido, hexadecanesulfonamido, benzenesulfonamido, p-toluenesulfonamido, octadecanesulfonamido, or 2-methoxy-5-tert-butylbenzenesulfonamido), a carbamoyl group (preferably having from 1 to 36 carbon atoms, e.g., N-ethylcarbamoyl, N,N-dibutylcarbamoyl, N-(2-dodecyloxyethyl)carbamoyl, N-methyl-N-dodecylcarbamoyl, or N-[3-(2,4-di-tert-amylphenoxy) propyl]-carbamoyl), a sulfamoyl group (preferably having from 1 to 36 carbon atoms, specifically, e.g., N-ethylsulfamoyl, N-(2-dodecyloxyethyl)sulfamoyl, N-ethyl-N-dodecylsulfamoyl, N,N-diethylsulfamoyl or N,N-dipropylsulfamoyl), a sulfonyl group (preferably an alkyl- or aryl-sulfonyl group having form 1 to 36 carbon atoms, specifically, e.g., methanesulfonyl, octane-sulfonyl, benzenesulfonyl, or toluenesulfonyl), an alkoxy-carbonyl group (preferably having from 2 to 36 carbon atoms, specifically, e.g., methoxycarbonyl, butoxycarbonyl, dodecyl-oxycarbonyl, or octadecyloxycarbonyl), a heterocyclicoxy group (preferably having from 1 to 36 carbon atoms, specifically, e.g., 1-phenyltetrazol-5-oxy, or 2-tetrahydropyranyloxy), an azo group (e.g., phenylazo, 4-methoxyphenylazo, 4-pivaloyl-aminophenylazo, or 2-hydroxy-4-propanoylphenylazo), an acyloxy group (preferably having from 2 to 36 carbon atoms, specifically, e.g., acetoxy), a carbamoyloxy group (preferably having from 1 to 36 carbon atoms, specifically, e.g., N-ethylcarbomoyloxy, or N-phenylcarbamoyloxy), a silyloxy group (preferably having from 3 to 36 carbon atoms, specifically, e.g., trimethylsilyloxy, or dibutylmethylsilyloxy), an aryloxycarbonylamino group (preferably having from 7 to 36 carbon atoms, specifically, e.g., phenoxycarbonylamino), an imido group (preferably having from 4 to 36 carbon atoms, specifically, e.g., N-succinimido, hydantoinyl, N-phthalimido, or 3-octadecenylsuccinimido), a heterocyclicthio group (preferably having from 1 to 36 carbon atoms, specifically, e.g., 2-benzothiaozlylthio, 2,4-di-phenoxy-1,3,5-triazol-6-thio, or 2-pyridylthio), a sulfinyl group (preferably having from 1 to 36 carbon atoms, specifically, e.g., dodecane-sulfinyl, 3-pentadecylphenylsulfinyl, or 3-phenoxypropyl-sulfinyl), an aryl- or heterocyclicoxycarbonyl group (e.g., phenyloxycarbonyl, or 2-pentadecyloxyphenylcarbonyl), a heterocyclicoxycarbonylamino group (e.g., 2,4-di-tert-butylphenoxycarbonylamino), a phosphonyl group (e.g., phenoxy-phosphonyl, octyloxyphosphonyl, or phenylphosphonyl), an azolyl group (e.g., imidazolyl, pyrazolyl, 3-chloropyrazol-1-yl, or triazolyl), a sulfo group, and an unsubstituted amino group.

$R_6$ is preferably an alkyl group, an aryl group, a heterocyclic group, a cyano group, a nitro group, an acylamino group, an arylamino group, a ureido group, a sulfamoylamino group, an alkylthio group, an arylthio group, an alkoxy-carbonylamino group, a sulfonamido group, a carbamoyl group, a sulfamoyl group, a sulfonyl group, an alkoxycarbonyl group, an aryloxycarbonyl group, a heterocyclicoxy group, an acyloxy group, a carbamoyloxy group, an aryloxycarbonylamino group, an imido group, a heterocyclicthio group, a sulfinyl group, a phosphonyl group, an acyl group, or an azolyl group.

More preferably, $R_6$ is an alkyl group or an aryl group. Sill more preferably, $R_6$ is a substituted aryl group. Particularly preferred group for $R_6$ is a phenyl group substituted with an aliphatic group for $R_6$ as described hereinbefore in its 4-position. The phenyl group may further be substituted in position(s) other than the 4-position.

X represents a heterocyclic group, a substituted amino group or an aryl group as described above. A heterocyclic ring for forming the heterocyclic group represented by X is preferably a 5-membered to 8-membered ring containing a nitrogen atom, an oxygen atom or a sulfur atom and having from 1 to 36 carbon atoms. A 5-membered or 6-membered nitrogen-containing heterocyclic ring which is connected to the carbonyl group through the nitrogen atom is more preferred. Among others, the 6-membered nitrogen-containing heterocyclic ring connecting through the nitrogen atom is particularly preferred.

Specific examples of the heterocyclic ring include imidazole, pyrazole, triazole, a lactam compound, piperidine, pyrrolidine, pyrrole, morpholine, pyrazolidine, thiazolidine and pyrazoline. Preferred rings are morpholine and piperidine, and morpholine is particularly preferred.

A substituent for the substituted amino group include an aliphatic group, an aryl group and a heterocyclic group. Suitable examples of the aliphatic group include those described for $R_6$ above. The aliphatic group may be substituted with a cyano group, an alkoxy group (e.g., methoxy), an alkoxycarbonyl group (e.g., ethoxycarbonyl), a chlorine atom, a hydroxy group or a carboxy group.

When the substituent for the substituted amino group is an aryl group, the aryl group has preferably from 6 to 36 carbon atoms. A monocyclic aryl group is preferred. Specific examples of the aryl group include phenyl, 4-tert-butylphenyl, 2-methylpenyl, 2,4,6-trimethylphenyl, 2-methoxyphenyl, 4-methoxyphenyl, 2,6-dichlorophenyl, 2-chlorophenyl and 2,4-dichlorophenyl.

Y represents a hydrogen atom or a substituent as described above. The substituent represented by Y is preferably a group capable of being released from the cyan dye forming coupler represented by the formula (I) upon the reaction with a developing agent and includes the group capable of being released under an alkaline condition as described, for example, in JP-A-61-228444 and the group capable of being released upon the reaction with a developing agent as described in JP-A-56-133734. Y is preferably a hydrogen atom.

The cyan dye forming coupler of the formula (I) may be a dimer or more, in which $R_6$ contains a residue of the cyan dye forming coupler of the formula (I), or may be a homopolymer or a copolymer, in which $R_6$ contains a polymer chain. Typical examples of the homopolymer or copolymer include homopolymers or copolymers formed from an addition-polymerizable ethylenically unsaturated compound having a residue of the cyan dye forming coupler of the formula (I). Such homopolymers or copolymers may contain one or more cyan color forming repeating units containing a residue of the cyan dye forming coupler of the formula (I). The copolymers may contain one or more non-color forming ethylenic monomers that do not couple with an oxidation product of an aromatic primary amine developing agent, such as acrylates, methacrylates or maleates.

Specific examples of the cyan coupler used in the present invention are set forth below, but the present invention should not be construed as being limited thereto.

(1)

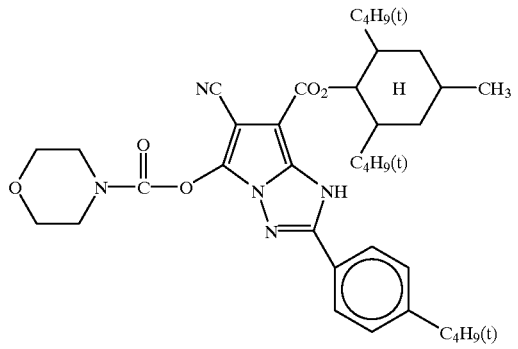

(2)

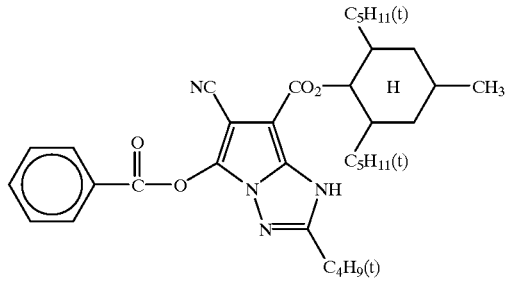

(3)

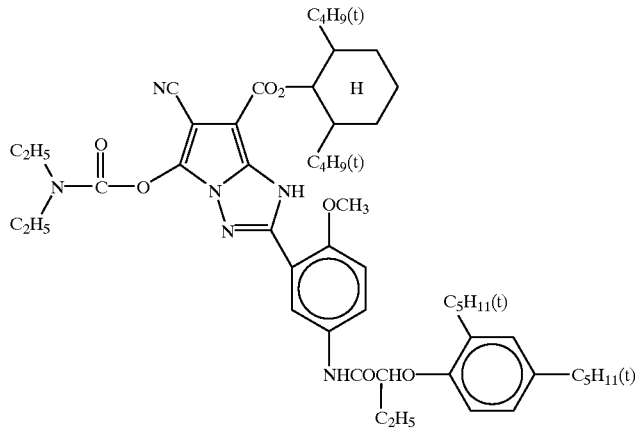

-continued
(4)
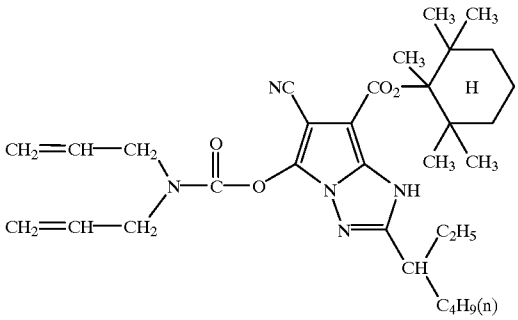
(5)
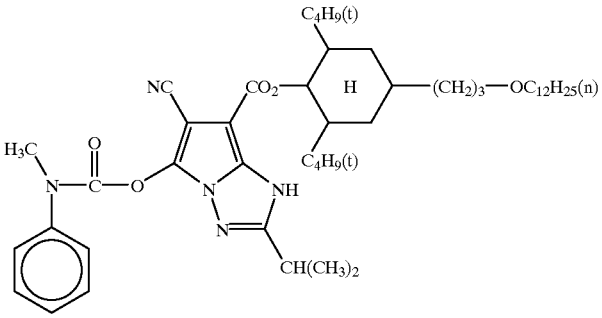
(6)
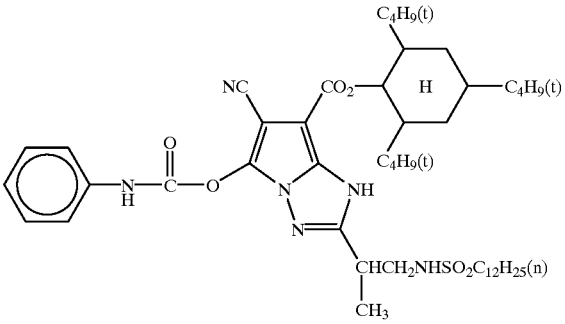
(7)
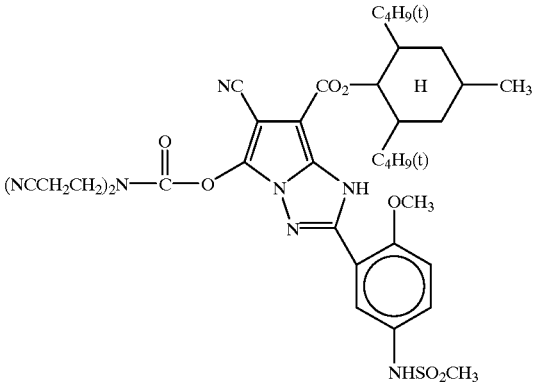

-continued
(8)
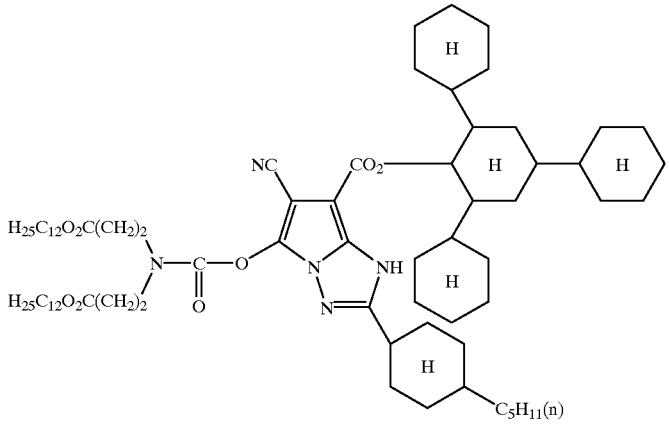
(9)
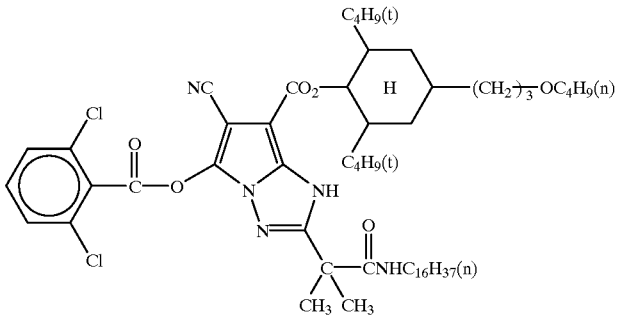
(10)
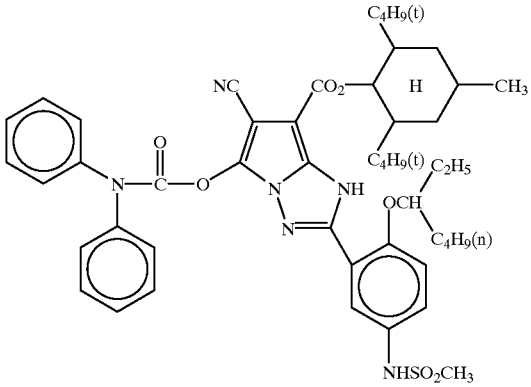
(11)
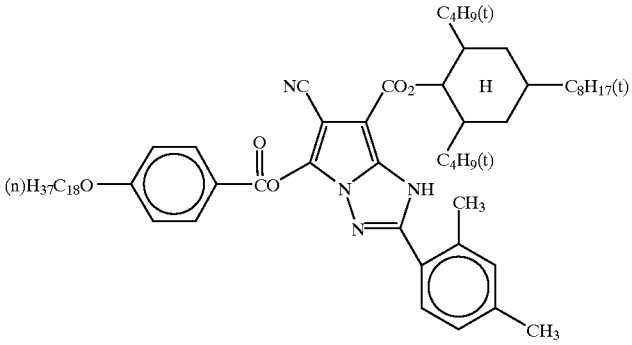

-continued
(12)
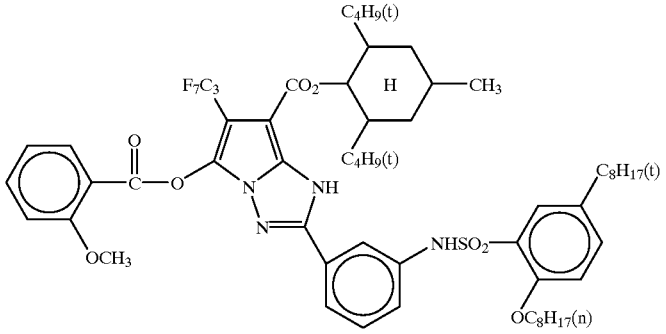
(13)
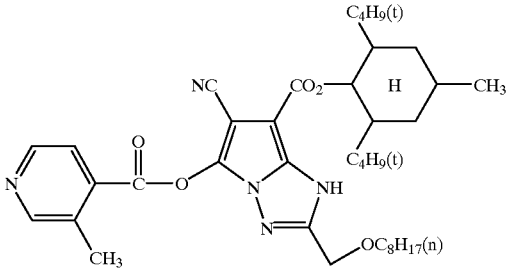
(14)
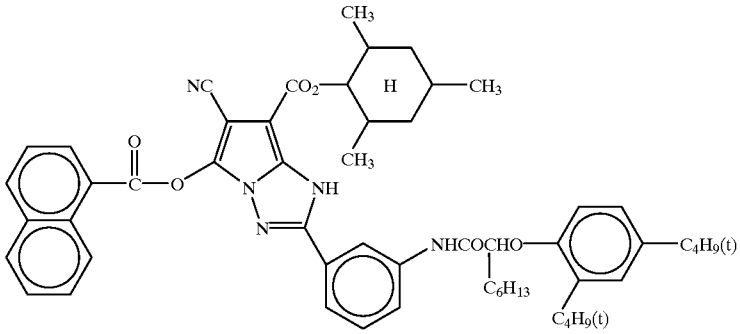
(15)
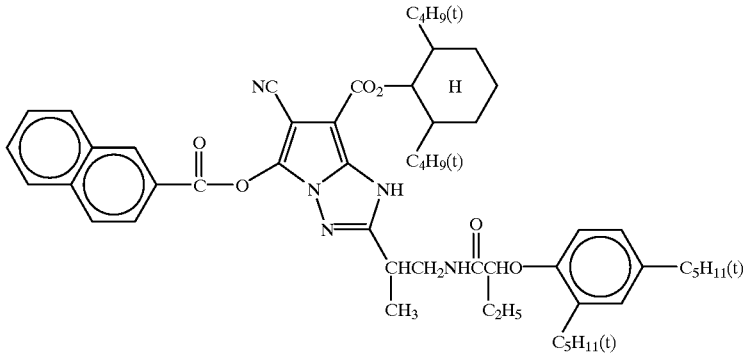

-continued
(16)
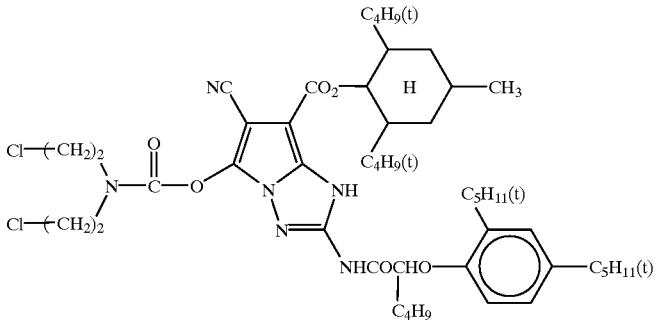
(17)
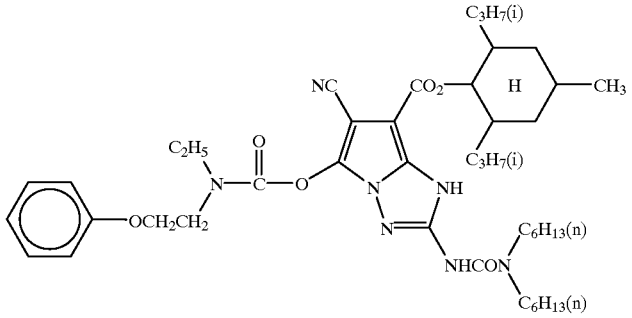
(18)
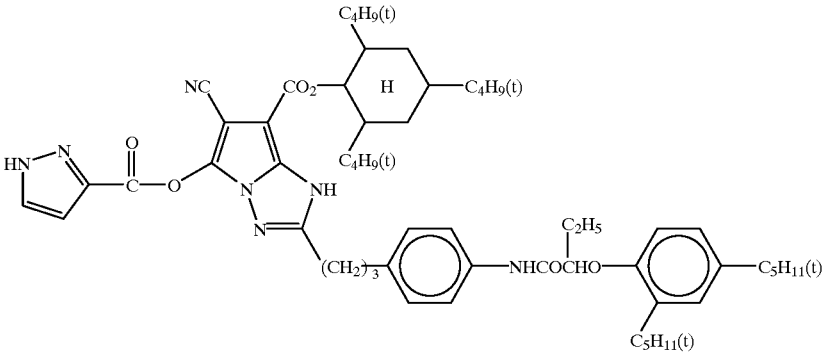
(19)
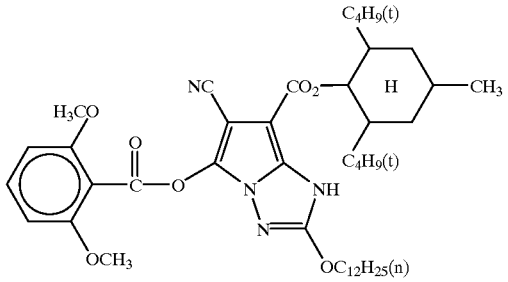

-continued
(20)
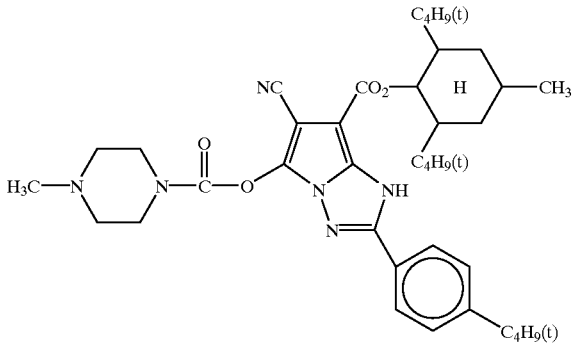
(21)
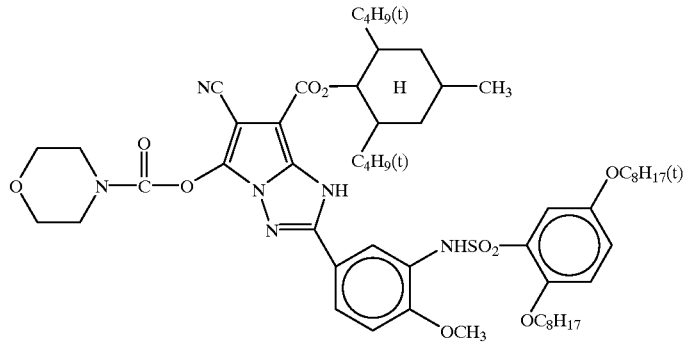
(22)
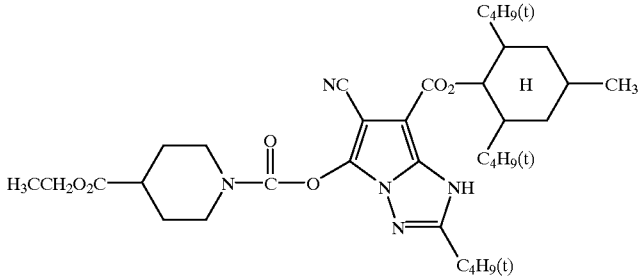
(23)
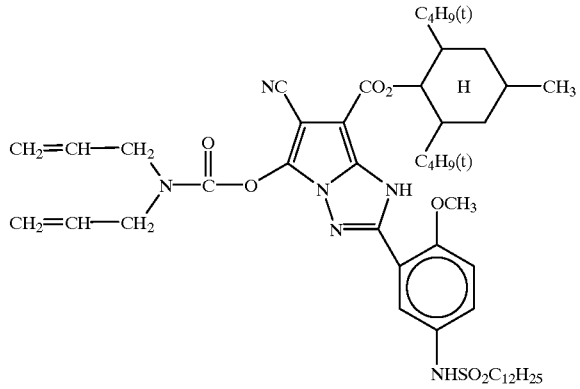

-continued
(24)
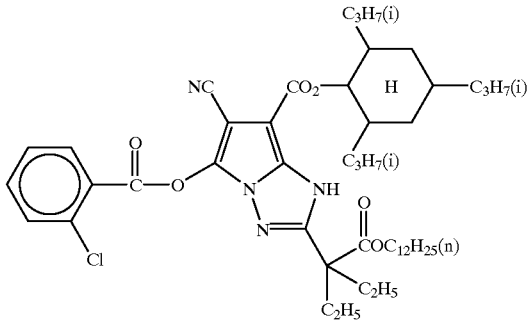
(25)
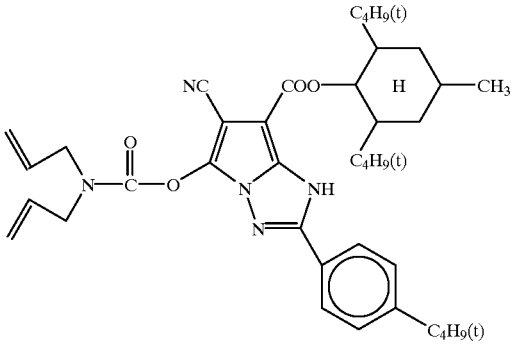
(26)
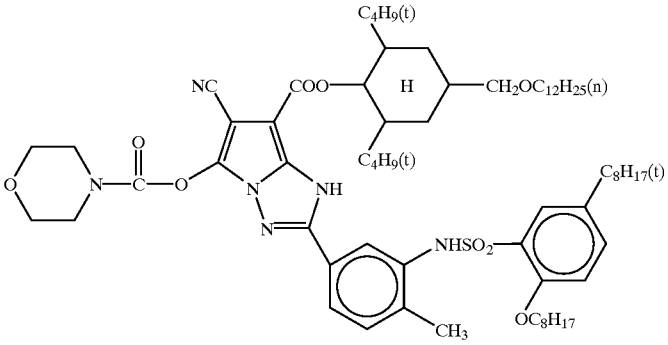
(27)
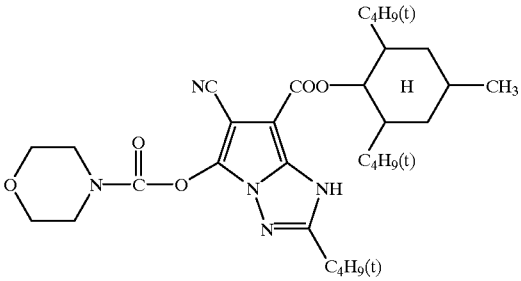

-continued
(28)
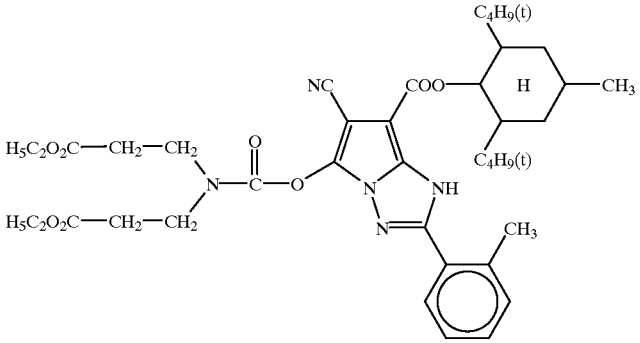
(29)
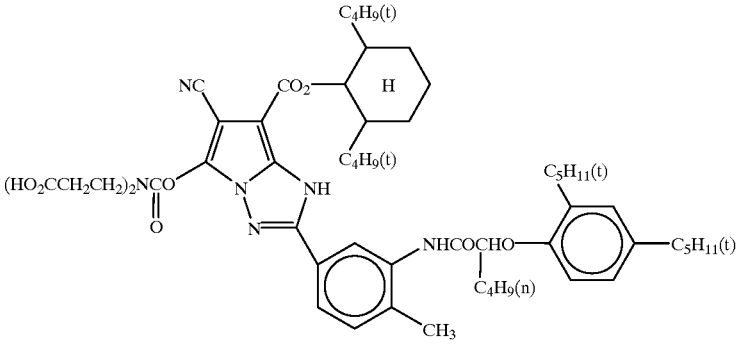
(30)
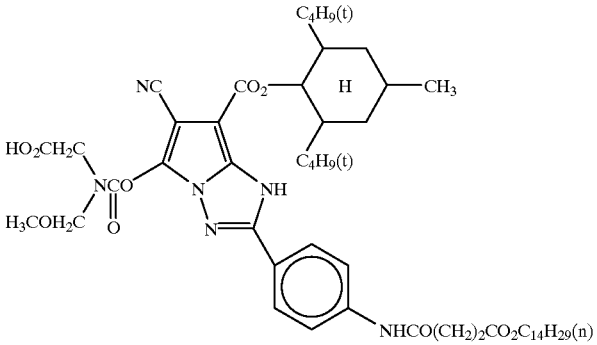
(31)
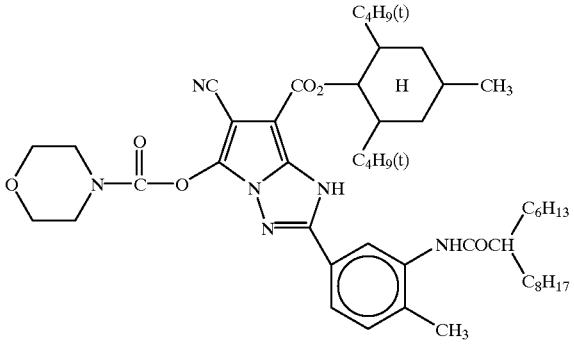

-continued (32)

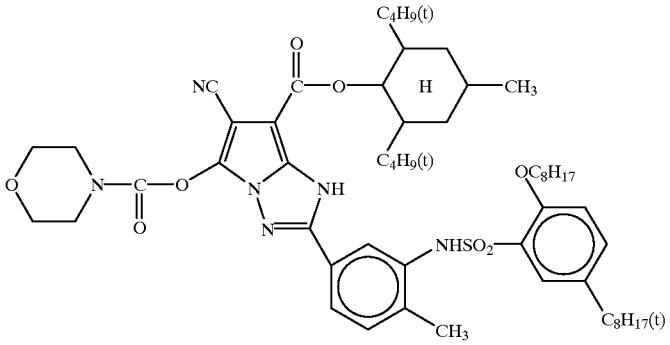

(33)

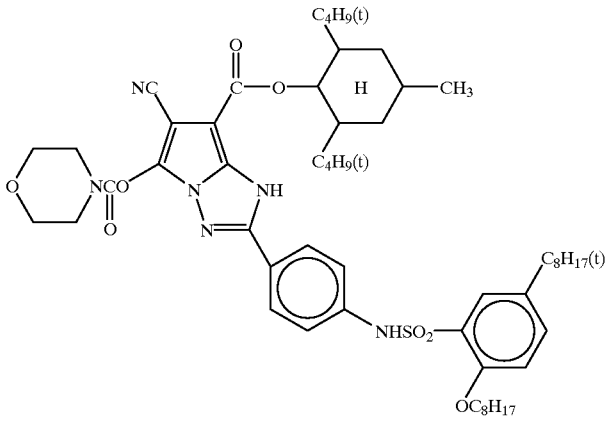

(34)

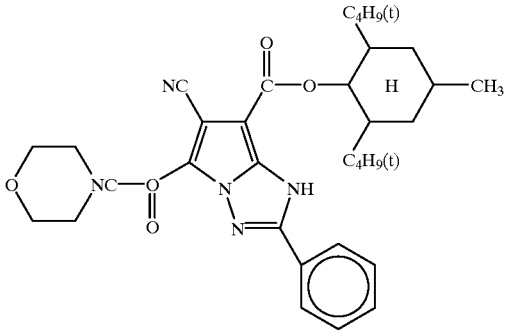

In the silver halide emulsion layer containing the cyan coupler according to the present invention, an amount of silver to the cyan coupler can be appropriately selected. In view of good color forming property and color reproducibility, a molar ratio of the silver to the cyan coupler is preferably from 2.0 to 8.0, more preferably from 2.8 to 6.0, and still more preferably from 2.8 to 5.0.

In order to incorporate the cyan coupler of the present invention into the silver halide photographic light-sensitive material, known dispersion methods, for example, an oil-droplet-in-water dispersion method using a high-boiling point organic solvent described in detail below or a latex dispersion method can be employed.

An average particle size of the oleophilic fine particle dispersion obtained according to the above-described dispersion method is preferably from 0.04 to 0.50 μm, more preferably from 0.05 to 0.30 μm, and still more preferably from 0.08 to 0.20 μm. The average grain size can be measured by Coulter Submicron Particle Analyzer Model N4 (manufactured by Coulter Electronics Co., Ltd.)

In the oil-droplet-in-water dispersion method using a high-boiling point organic solvent, an amount of the high-boiling point organic solvent is appropriately selected. A weight ratio of the high-boiling point organic solvent to the total coupler used is preferably from 0.5 to 2.5. It is also possible that the high-boiling point organic solvent is not used at all.

The high-boiling organic solvent which can be preferably used together with the cyan coupler according to the present invention includes a phosphoric ester, a phosphonic ester, a phosphinic ester and a phosphinoxide (hereinafter simply referred to as a phosphoric ester type high-boiling point organic solvent) from the standpoint of dependence on processing conditions, color reproducibility and light fastness.

Suitable examples of the phosphoric ester type high-boiling point organic solvent include the compound represented by the following formula (S):

(S)

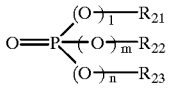

wherein $R_{21}$, $R_{22}$ and $R_{23}$ each represents an aryl group; and l, m and n each represents 1 or 0.

In the formula (S), the aryl group may be substituted. Specific examples of the aryl group include a phenyl, cresyl, p-nonylphenyl, xylyl, cumenyl, p-methoxy-phenyl, p-methoxycarbonylphenyl, o-isopropylphenyl, m-isopropylphenyl, p-isopropylphenyl or o,p-diisopropylphenyl group.

For $R_{21}$, $R_{22}$ and $R_{23}$, an aryl group substituted with an alkyl group exemplified in the specific examples of the aryl group as described above is preferred, and an o-, m- or p-isopropylphenyl group is particularly preferred. With respect to l, m and n, it is preferred that each of l, m and n is 1 or at least one of l, m and n is 0.

The high-boiling point organic solvent has a boiling point of about 150° C. or higher, preferably 170° C. or higher, at a normal pressure. The form of the high-boiling point organic solvent at room temperature may be any of a low-melting point crystal, amorphous solid and paste as well as liquid. When the organic solvent has a crystalline form at room temperature, its melting point is preferably not more than 100° C., more preferably not more than 80° C. The high-boiling point organic solvent may be employed individually or as a mixture of two or more thereof. In case of using the mixture of two or more high-boiling point organic solvents, at least one of them is the phosphoric ester type high-boiling point organic solvent and the other may be any type of high-boiling point organic solvent.

The organic solvents used together with the phosphoric ester type high-boiling point organic solvent include esters of aromatic carboxylic acid such as phthalic acid or benzoic acid, esters of aliphatic carboxylic acid such as succinic acid or adipic acid, amide type compounds, epoxy type compounds, aniline type compounds and phenolic compounds. When the phosphoric ester type high-boiling point solvent which has crystalline form and a melting point of 80° C. or higher is employed, it is preferred to use two or more high-boiling point organic solvents as a mixture. When the phosphoric ester type high-boiling point organic solvent is used together with other high-boiling point organic solvent, a ratio of the phosphoric ester type high-boiling point organic solvent in the mixture is preferably not less than 25% by weight, more preferably not less than 50% by weight in case of using the phosphoric ester, or preferably not less than 10% by weight, more preferably not less than 20% by weight in case of using the phosphonic ester, phosphinic ester or phosphinoxide.

Specific examples of the high-boiling point organic solvent represented by the formula (S) are set forth below, but the present invention should not be construed as being limited thereto.

S-1

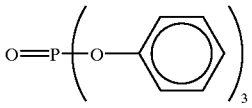

-continued

S-2

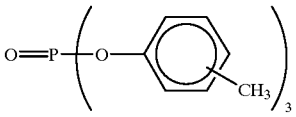

S-3

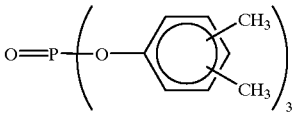

S-4

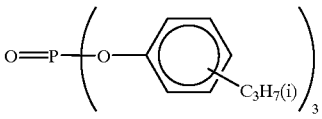

S-5

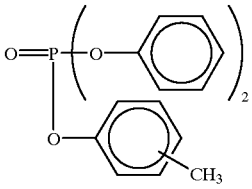

S-6

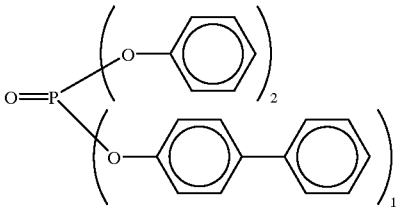

S-7

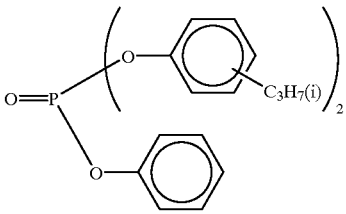

S-8

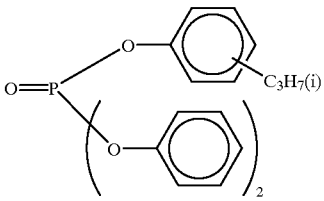

S-9

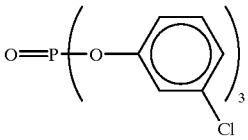

-continued

S-10

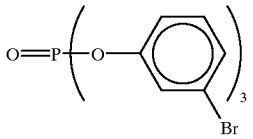

S-11

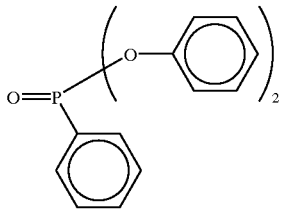

S-12

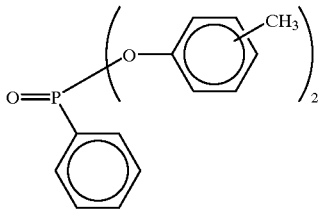

The color photographic light-sensitive material of the present invention preferably comprises a reflective support having coated thereon at least one yellow color forming silver halide emulsion layer, at least one magenta color forming silver halide emulsion layer, and at least one cyan color forming silver halide emulsion layer. Further, in the photographic light-sensitive material, between the support and the light-sensitive layer, between the light-sensitive layer and the light-sensitive layer, or on the light-sensitive layer (the farthest layer from the support), light-insensitive layer(s) can be provided for various purposes, for example, color mixing prevention, anti-irradiation/antihalation, light-filtering or protection of the light-sensitive layer.

The silver halide emulsion which can be used in the present invention will be described in greater detail below.

The silver halide emulsion used in at least one of the light-sensitive layer containing the cyan color forming coupler according to the present invention is composed of tabular silver halide grains having (100) faces as major faces and a silver chloride content of 80 mol % or more as described above. The silver chloride content in the grains is preferably 90 mol % or more, and more preferably 95 mol % or more.

The silver halide emulsion used in the present invention comprises at least a dispersion medium, typically gelatin and the above-described silver halide grains, and the projected areas of the tabular silver halide grains having the (100) faces as major faces occupy 10% or more, preferably from 35% to 100%, and more preferably from 60 to 100% based on the total projected areas of the whole silver halide grains in the emulsion. The projected areas used herein mean the projected areas of the grains when arranged on the substrate in the state that the silver halide emulsion grains do not overlap with one another, and in the state that the major faces are parallel to substrate planes for the tabular grains. The term "major faces" means two parallel maximum outer faces in one tabular grain. The aspect ratio (diameter/thickness) of the tabular grains is usually 1.5 or more, preferably 2 or more, more preferably from 3 to 25, and still more preferably from 3 to 7. Here, the term "diameter" denotes the diameter of a circle having the same area as the projected area of a grain observed under an electron microscope. Further, the term "thickness" means the distance between the major faces of the tabular grain. The diameter of the tabular silver halide grains is preferably 10 $\mu$m or less, more preferably from 0.2 to 5 $\mu$m, and still more preferably from 0.2 to 3 $\mu$m. The thickness is preferably 0.7 $\mu$m or less, more preferably from 0.03 to 0.3 $\mu$m, and still more preferably from 0.05 to 0.2 $\mu$m. The grain size distribution of the tabular grains is preferably monodisperse, and the coefficient of variation is preferably 40% or less, and more preferably 20% or less.

The tabular silver halide grains having the (100) faces as major faces and a silver chloride content of 80 mol % or more in the present invention can also be prepared by the method described in EP-A-534395, page 7, line 53 to page 19, line 35, or JP-A-6-59360, paragraph Nos. 0006 to 0024. However, all of these grains have no gap phases discontinuous in halogen composition in the center portions, and are of the uniform halogen composition type or of the gently changing halogen composition type. In this case, it is difficult to produce the tabular grains so as to have the required properties, which occasionally causes production variations. Further, the size distribution becomes broad, so that sensitivity, gradation, or granularity is unsuitable in image quality in some cases.

In order to solve such problems, it is preferred that the grains have the gap phases discontinuous in halogen composition in the nuclei thereof. The grain contains at least one gap phase discontinuous in halogen composition, preferably 2 to 4 gap phases, and more preferably 2 gap phases.

1) Specific examples when the grain has one gap phase discontinuous in halogen composition An AgCl nucleus is laminated with AgBr (AgCl/AgBr), AgCl is laminated with AgBrI (AgCl/AgBrI), and AgClBr is laminated with AgBr (AgClBr/AgBr). More generally, they are expressed by (AgX1/AgX2), wherein X1 different from X2 in $Cl^-$ content or $Br^-$ content by from 10 to 100 mol %, preferably from 30 to 100 mol %, more preferably from 50 to 100 mol %, and still more preferably from 70 to 100 mol %. In addition to the above-described differences in $Cl^-$ content or $Br^-$ content, or individually, the difference in $I^-$ content is by from 5 to 100 mol %, preferably from 10 to 100 mol %, more preferably from 30 to 100 mol %, and still more preferably from 50 to 100 mol %. 2) Specific examples when the grain has two gap phases discontinuous in halogen composition Examples represented by the above-mentioned description include (AgBr/AgCl/AgBr), (AgCl/AgBr/AgCl), (AgBrI/AgCl/AgBrI) and (AgCl/AgClBr/AgCl). More generally, they are expressed by (AgX1/AgX2/AgX3), wherein X1 and X3 may be the same or different. The gap discontinuous in halogen composition between the respective adjacent layers is as specified above.

The gap phase has the difference discontinuous in halogen composition. Specifically, the difference means that the halogen composition of a halogen salt solution (hereinafter referred to as "an X-salt solution") to be added or the halogen composition of fine silver halide grains to be added is changed at the gap phase as specified above, and does not mean the structure of the grain itself. It is particularly preferred that the gap in halogen composition is not the gap in $I^-$ content, but different in $Br^-$ content. It is further preferred that the grain has two gap phases in $Br^-$ content.

The diameter of circles equivalent to the projected areas of the nuclei of the tabular grains here is preferably 0.15 $\mu$m or less, more preferably from 0.02 to 0.1 $\mu$m, and still more preferably from 0.02 to 0.06 μm. The term "nuclei" used here denote the portions of nuclei containing the gap phase formed in the preparation of grains.

The thickness of the AgX2 layer is preferably an amount covering a surface of the AgX1 layer with one lattice layer on average, more preferably an amount covering the AgX1 layer with from 3 lattice layers to 10-fold molar amount of the AgX1 layer, and still more preferably an amount covering the AgX1 layer with from 10 lattice layers to 3-fold molar amount of the AgX1 layer. It is preferred that the gap structure is equal between the grains. This is because the grains equal in (the number of screw dislocation/grain) are formed, and because the tabular grains having a narrow grain size distribution (uniform size and form of the grains) are formed.

Of the tabular silver halide grains used in the present invention, those having silver bromide localized phases on the surfaces thereof in addition to the gas phase discontinuous in halogen composition in the nuclei thereof are preferred. The silver bromide content of the halogen composition in the above-described localized phases is preferably at least 10 mol %, and more preferably above 20 mol %. The silver bromide content of the silver bromide localized phases can be analyzed according to the X-ray diffraction method (for example, Shin-Jikken Kagaku Koza 6, Kozo Kaiseki (New Experimental Chemistry Course 6, Analysis of Structure), edited by Nippon Kagaku Kai, published by Maruzen). These localized phases can be present on edges, corners or on planes of the grain surface. One preferred example of the localized phase includes that formed by epitaxial growth on the corners of the grains.

Also, it is effective to further increase the silver chloride content of the silver halide emulsion in order to reduce a replenishing amount of the development processing solution. In such a case, substantially a pure silver chloride emulsion having a silver chloride content of from 98 mol % to 100 mol % is also preferably used.

Further, it is preferred that the above described tabular silver halide emulsions are blended to use in the same layer or they are coated to form multiple layers, for the purpose of obtaining a wide latitude.

Silver halide grains used in the light-sensitive layers other than the cyan color forming layer in the present invention is not particularly restricted. Silver halide grains having a regular crystal form such as cubic, tetradecahedral or octahedral, an irregular crystal form such as spherical or plate-like, or a composite form of these forms, or tabular same as in the cyan color forming layer. In order to match developing speed or dependence on processing conditions of each light-sensitive layer, it is preferred to employ the tabular silver halide grains as described above in the whole light-sensitive layers of the silver halide color photographic light-sensitive material.

It is preferred that the silver halide color photographic light-sensitive material of the present invention has a reflection density of not less than 0.25, more preferably 0.3 to 1, further preferably 0.3 to 0.7, at a wavelength of 550 nm. When the reflection density is less than 0.25, it is sometimes difficult to obtain a color image excellent in sharpness. More preferably, the reflection density of the photographic light-sensitive material is not less than 0.5 at a wavelength of 550 nm.

The reflection density of the photographic light-sensitive material can be measured with a reflection densitometer commonly employed in the field of art, and is defined as follows:

$$\text{Reflection Density} = -\text{Log}\{F(550\text{ nm})/F_0\ (550\text{ nm})\}$$

wherein $F_0$ (550 nm) is a quantity of light reflected on a standard white board at a wavelength of 550 nm; and F (550 nm) is a quantity of light reflected on a sample at a wavelength of 550 nm.

In order to increase the reflection density of the photographic light-sensitive material to 0.3 or more, a method of adding to a hydrophilic colloidal layer thereof a dye which can be decolored on processing (i.e., an oxonol dye or a cyanine dye) as described in EP-A-337490, pages 27 to 76. In case of using such a dye, it is recommended to choose a dye whose adsorption overlaps the spectral sensitivity maximum of the light-sensitive layer.

Some of these water-soluble dyes show deteriorated color differentiation if used in an increased amount. It is preferable to use water-soluble dyes which are employed without undergoing the deterioration of color differentiation such as those described in JP-A-5-216185, JP-A-5-127325, and JP-A-5-127324.

The above-described water-soluble dyes may be used in combination with a colored layer which can be decolored on processing. The colored layer capable of being decolored by processing may be provided in direct contact with an emulsion layer or via an intermediate layer containing gelatin and a color mixing preventing agent such as a hydroquinone. The colored layer is preferably provided below (closer to the support than) an emulsion layer whose spectral sensitivity maximum is in the absorption region of the colored layer. The colored layer corresponding to every primary color may be provided, or the color layer corresponding to a part of the primary colors may be provided. The colored layer corresponding to a plurality of primary color regions may be provided.

In order to form the colored layer, conventionally known methods can be employed. For example, there are a method wherein a dye is incorporated into a hydrophilic colloidal layer in the form of a dispersion of fine solid particles as described in JP-A-2-282244, page 3, upper right column to page 8 and JP-A-3-7931, page, 3, upper right column to page 11, lower left column, a method wherein an anionic dye is fixed to a cation polymer as a mordant, a method wherein a dye is adsorbed onto fine particles, for example, silver halide and fixed in a layer, or a method wherein colloidal silver is utilized as a light absorber as described in JP-A-1-239544. As for dispersion of fine powder of a dye in a solid state, a method of incorporating fine powder of a dye which is substantially water-insoluble at a pH of 6 or lower but is substantially water-soluble at a pH of 8 or higher is disclosed in JP-A-2-308244, pages 4 to 13. The method for mordanting an anionic dye to a cationic polymer is described in JP-A-2-84637, pages 18 to 26. Preparation of colloidal silver as a light absorber is described in U.S. Pat. Nos. 2,688,601 and 3,459,563. It is also preferred to use tabular thin colloidal silver grains having a thickness of up to 20 nm as described in JP-A-5-134358. Of these methods, the method of incorporating fine particles of a dye and the method of using colloidal silver are preferred.

In the present invention, it is particularly preferable to employ a water-soluble dye represented by the formula (IX) described above either individually or in combination with the above-described water-soluble dye.

Now, the water-soluble dye represented by the formula (IX) will be described in greater detail below.

In the formula (IX), at least one of the total atomic weight of $R_1$ and $R_3$ and the total atomic weight of $R_2$ and $R_4$ should be not more than 160. Preferably both of the total atomic weights are not more than 160. The total atomic weight is more preferably not more than 130.

$R_1$, $R_2$, $R_3$ and $R_4$ each is preferably selected from a hydrogen atom, an alkyl group, —$COOR_5$, —$CONR_6R_7$, —$CONHR_8$, —$NR_9COR_{10}$, —$NR_{11}R_{12}$, —CN, —$OR_{13}$ or —$NR_{14}CONR_{15}R_{16}$, wherein $R_5$, $R_6$, $R_7$, $R_8$, $R_9$, $R_{10}$, $R_{11}$, $R_{12}$, $R_{13}$, $R_{14}$, $R_{15}$ and $R_{16}$ each represents a hydrogen atom or a substituted or unsubstituted alkyl group; $R_6$ and $R_7$, $R_{11}$, and $R_{12}$, or $R_{15}$ and $R_{16}$ may be taken together to form a ring.

It is more preferred that $R_1$, $R_2$, $R_3$, and $R_4$ each has no dissociation group. The term "dissociation group" as used herein means a substituent which is substantially dissociated in water at 25° C. and has a pKa of not more than 12. Such a dissociation group includes a sulfonic acid group, a carboxy group, and a phosphoric acid group.

More preferably, $R_1$ and $R_2$ each represents a hydrogen atom or an alkyl group. The alkyl group is preferably an alkyl group having 3 or less carbon atoms, e.g., a methyl, ethyl or propyl group, which may have a substituent. The substituent preferably includes one having an unshared electron pair, for example, a hydroxyl group, an ether group, an ester group, a carbamoyl group, a sulfonyl group, a sulfamoyl group, and a cyano group. Of these substituents, a hydroxyl group and an ether group are particularly preferred.

The alkali metal represented by M is preferably Li, Na, K or Cs.

The alkyl group represented by $R_3$ and/or $R_4$ is preferably a lower alkyl group such as a methyl, ethyl, propyl or butyl group. A methyl group and an ethyl group are particularly preferred.

When $R_3$ and/or $R_4$ represent —$COOR_5$, the alkyl group as $R_5$ is preferably a lower alkyl group such as a methyl, ethyl, propyl or butyl group, with a methyl or ethyl group being particularly preferred.

When $R_3$ and/or $R_4$ represent —$CONR_6R_7$, $R_6$ and $R_7$ each represents a hydrogen atom or an alkyl group. At least one of $R_6$ and $R_7$ is preferably an alkyl group. The alkyl group is preferably a methyl group, an ethyl group or a propyl group, which may have a substituent. The substituent preferably includes a hydroxyl group and an ether group. $R_6$ and $R_7$ may be taken together to form a ring, preferably a morpholine ring.

When $R_3$ and/or $R_4$ represent —$CONHR_8$, and $R_8$ is an alkyl group, the alkyl group has the same meaning as that set forth for $R_6$ or $R_7$.

When $R_3$ and/or $R_4$ represent —$NR_9COR_{10}$, $R_9$ and $R_{10}$ each represents a hydrogen atom or an alkyl group. The alkyl group is preferably a methyl group, an ethyl group or a propyl group, which may have a substituent, with a methyl group being particularly preferred. The substituent preferably includes a hydroxyl group and an ether group.

When $R_3$ and/or $R_4$ represent —$NR_{11}R_{12}$ or —$OR_{13}$, $R_{11}$, $R_{12}$, and $R_{13}$ each represents a hydrogen atom or an alkyl group. The alkyl group is preferably a methyl group, an ethyl group or a propyl group, which may have a substituent. The substituent preferably includes a hydroxyl group and an ether group. $R_{11}$ and $R_{12}$ may be taken together to form a ring.

When $R_3$ and/or $R_4$ represent —$NR_{14}CONR_{15}R_{16}$, $R_{14}$, $R_{15}$, and $R_{16}$ each represents a hydrogen atom or an alkyl group. The alkyl group is preferably a methyl group, an ethyl group or a propyl group, with a methyl group being particularly preferred, which may have a substituent. The substituent preferably includes a hydroxyl group and an ether group.

Of the above-described groups, $R_3$ and $R_4$ each preferably represents —$CONR_6R_7$, more preferably —$CONR_6R_7$ in which $R_6$ and $R_7$ are taken together to form a 5- or 6-membered ring, and still more preferably —$CONR_6R_7$ in which $R_6$ and $R_7$ are taken together to form a morpholine ring.

Of the water-soluble dyes represented by the formula (IX), those represented by the following formula (X) are preferred.

(X)

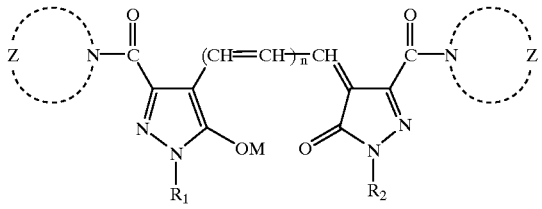

wherein $R_1$ and $R_2$ each represents a hydrogen atom or a substituent; n represents 0, 1 or 2; M represents a hydrogen atom or an alkali metal; z represents an atomic group necessary to form a 5- or 6-membered saturated heterocyclic group together with the nitrogen atom; provided that at least one of the total atomic weight of $R_1$ and Z and the total atomic weight of $R_2$ and Z is not more than 130.

The dye is preferably present in a layer of the photographic light-sensitive material according to the present invention in a molecular dispersion state like a monomolecule or a dimer. The terminology "molecular dispersion state" as used herein means that the water-soluble dye represented by the formula (IX) or (X) is dispersed almost uniformly in an emulsion layer or any other hydrophilic colloidal layer, showing substantial no solid state. A more preferred state of the dye is the state of a monomolecule or a dimer.

Specific examples of the water-soluble dye represented by the formula (IX) used in the present invention are set forth below, but the present invention should not be construed as being limited thereto.

TABLE 1

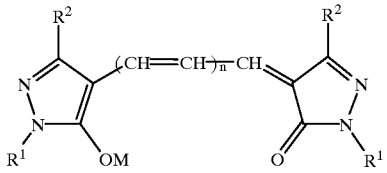

| | $R^1$ | $R^2$ | n | M |
|---|---|---|---|---|
| 1 | H | $CONHCH_2CH_2OH$ | 0 | K |
| 2 | H | $CON(CH_3)_2$ | 1 | K |
| 3 | H | 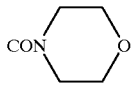 | 1 | K |
| 4 | $CH_3$ | $CONHCH_2CH_2OCH_3$ | 1 | K |
| 5 | $CH_2CH_3$ | $CONHCH_2CH_2OH$ | 1 | K |
| 6 | $CH_2CH_2OH$ | 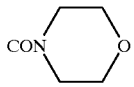 | 1 | K |

TABLE 1-continued

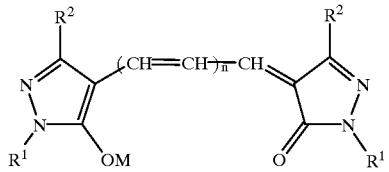

| | $R^1$ | $R^2$ | n | M |
|---|---|---|---|---|
| 7 | $CH_2CH_2OH$ | $CONHCH_2CH_2OH$ | 0 | K |
| 8 | $CH_2CH_2OH$ | $CONHCH_3$ | 1 | K |

TABLE 2

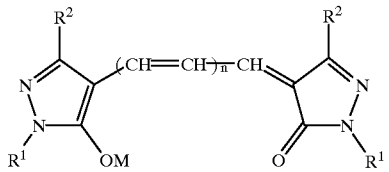

| | $R^1$ | $R^2$ | n | M |
|---|---|---|---|---|
| 9 | H | $CONHCH_2CH_2OH$ | 1 | K |
| 10 | H | $CON(CH_3)_2$ | 2 | K |
| 11 | $CH_3$ | 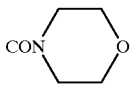 | 1 | K |
| 12 | $CH_3$ | $CONHCH_2CH_2OCH_3$ | 2 | Na |
| 13 | $CH_2CH_3$ | $CONHCH_2CH_2OH$ | 2 | K |
| 14 | $CH_2CH_2OH$ | 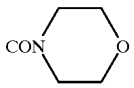 | 2 | K |
| 15 | $CH_2CH_2OH$ | $CONHCH_2CH_2OH$ | 2 | K |
| 16 | $CH_2CH_2OH$ | $CONHCH_3$ | 2 | K |

TABLE 3

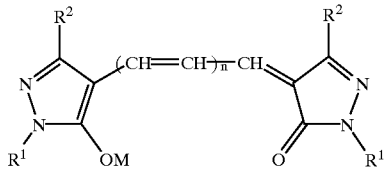

| | $R^1$ | $R^2$ | n | M |
|---|---|---|---|---|
| 17 | H | $COOC_2H_5$ | 0 | K |
| 18 | H | $COOCH_3$ | 1 | K |
| 19 | $CH_3$ | $COOC_2H_5$ | 1 | Na |
| 20 | $CH_3$ | $COOCH_2CH_2OCH_3$ | 1 | K |
| 21 | $CH_2CH_3$ | $COOC_2H_5$ | 0 | K |
| 22 | $CH_2COOC_2H_5$ | $COOC_2H_5$ | 1 | K |
| 23 | $CH_2CH_2OH$ | $COOC_2H_5$ | 1 | K |

TABLE 4

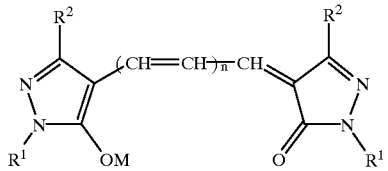

| | $R^1$ | $R^2$ | n | M |
|---|---|---|---|---|
| 24 | H | $COOC_2H_5$ | 1 | K |
| 25 | H | $COOCH_3$ | 2 | K |
| 26 | $CH_3$ | $COOC_2H_5$ | 2 | K |
| 27 | $CH_3$ | $COOCH_2CH_2OCH_3$ | 2 | K |
| 28 | $CH_2CH_3$ | $COOC_2H_5$ | 2 | K |
| 29 | $CH_2COOC_2H_5$ | $COOC_2H_5$ | 2 | K |
| 30 | $CH_2CH_2OH$ | $COOC_2H_5$ | 2 | K |

TABLE 5

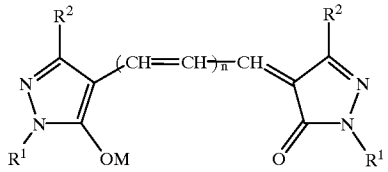

| | $R^1$ | $R^2$ | n | M |
|---|---|---|---|---|
| 31 | H | CN | 0 | K |
| 32 | H | CN | 1 | K |
| 33 | $CH_3$ | CN | 0 | K |
| 34 | $CH_3$ | CN | 1 | K |
| 35 | $CH_2CH_3$ | CN | 1 | K |
| 36 | $CH_2CH_3$ | CN | 2 | K |
| 37 | H | CN | 2 | K |
| 38 | $CH_3$ | CN | 2 | K |

TABLE 6

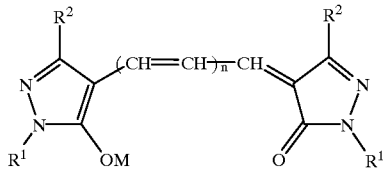

| | $R^1$ | $R^2$ | n | M |
|---|---|---|---|---|
| 39 | H | $CH_3$ | 1 | K |
| 40 | H | $CH_2CH_3$ | 1 | K |
| 41 | $CH_3$ | H | 1 | Na |
| 42 | $CH_3$ | $CH_3$ | 0 | K |
| 43 | $CH_2CH_3$ | $CH_3$ | 1 | K |
| 44 | $CH_2COOC_2H_5$ | $CH_3$ | 1 | K |
| 45 | $CH_2CH_2OH$ | $CH_3$ | 1 | K |
| 46 | $CH_2CH_2OH$ | $CH_2CH_3$ | 1 | K |

TABLE 7

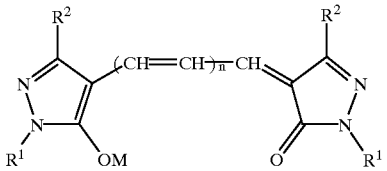

| | $R^1$ | $R^2$ | n | M |
|---|---|---|---|---|
| 47 | H | $CH_3$ | 2 | K |
| 48 | H | $CH_2CH_3$ | 2 | K |
| 49 | $CH_3$ | H | 2 | K |
| 50 | $CH_3$ | $CH_3$ | 2 | K |
| 51 | $CH_2CH_3$ | $CH_3$ | 2 | K |
| 52 | $CH_2COOC_2H_5$ | $CH_3$ | 2 | K |
| 53 | $CH_2CH_2OH$ | $CH_3$ | 2 | K |
| 54 | $CH_2CH_2OH$ | $CH_2CH_3$ | 2 | K |

TABLE 8

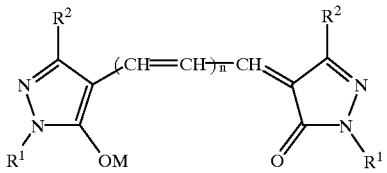

| | $R^1$ | $R^2$ | n | M |
|---|---|---|---|---|
| 55 | H | $OC_2H_5$ | 1 | K |
| 56 | H | $OC_2H_5$ | 2 | K |
| 57 | $CH_3$ | $OC_2H_5$ | 2 | K |
| 58 | $CH_3$ | OH | 1 | K |
| 59 | $CH_2CH_3$ | $OC_2H_5$ | 2 | K |
| 60 | $CH_2COOC_2H_5$ | $OC_2H_5$ | 2 | K |
| 61 | $CH_2CH_2OH$ | $OC_2H_5$ | 1 | K |
| 62 | $CH_2CH_2OH$ | $OC_2H_5$ | 2 | K |

TABLE 9

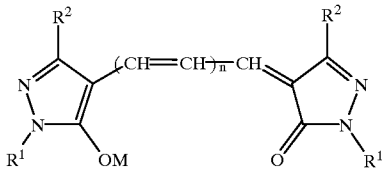

| | $R^1$ | $R^2$ | n | M |
|---|---|---|---|---|
| 63 | H | $OC_2H_5$ | 0 | K |
| 64 | H | $OCH_2CH_2OH$ | 1 | K |
| 65 | $CH_3$ | $OC_2H_5$ | 0 | K |
| 66 | $CH_3$ | OH | 2 | K |
| 67 | $CH_2CH_3$ | $OC_2H_5$ | 1 | K |
| 68 | $CH_2COOC_2H_5$ | $OC_2H_5$ | 1 | K |
| 69 | $CH_2CH_2OH$ | $OC_2H_5$ | 0 | K |
| 70 | $CH_2CH_2OH$ | $OCH_2CH_2OH$ | 1 | K |

TABLE 10

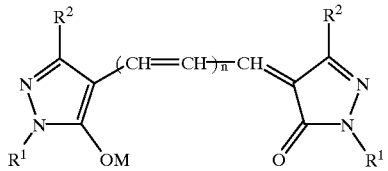

| | $R^1$ | $R^2$ | n | M |
|---|---|---|---|---|
| 71 | H | $NH_2$ | 0 | K |
| 72 | H | $NHCH_2CH_2OH$ | 1 | K |
| 73 | $CH_3$ | $NHCH_2CH_2OH$ | 0 | K |
| 74 | $CH_3$ | $NHCH_2CH_2OH$ | 1 | K |
| 75 | $CH_2CH_3$ | $NHCH_2CH_2OH$ | 1 | K |
| 76 | $CH_2COOC_2H_5$ | $NHCH_2CH_2OH$ | 1 | K |
| 77 | $CH_2CH_2OH$ | $NHCH_2CH_2OH$ | 0 | K |
| 78 | $CH_2CH_2OH$ | $NHCH_2CH_2OH$ | 1 | K |

TABLE 11

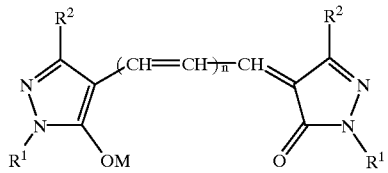

| | $R^1$ | $R^2$ | n | M |
|---|---|---|---|---|
| 79 | H | $NH_2$ | 1 | K |
| 80 | H | $NHCH_2CH_2OH$ | 2 | K |
| 81 | $CH_3$ | $NHCH_2CH_2OH$ | 2 | K |
| 82 | $CH_3$ | $NH_2$ | 1 | K |
| 83 | $CH_2CH_3$ | $NHCH_2CH_2OH$ | 2 | K |
| 84 | $CH_2COOC_2H_5$ | $NHCH_2CH_2OH$ | 2 | K |
| 85 | $CH_2CH_2OH$ | $NHCH_2CH_2OH$ | 2 | K |
| 86 | $CH_2CH_2OH$ | $NH_2$ | 1 | K |

TABLE 12

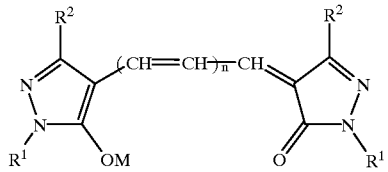

| | $R^1$ | $R^2$ | n | M |
|---|---|---|---|---|
| 87 | H | $NHCOCH_3$ | 1 | K |
| 88 | H | $NHCOCH_3$ | 2 | K |
| 89 | $CH_3$ | $NHCOCH_3$ | 1 | Na |
| 90 | $CH_3$ | $NHCOCH_3$ | 2 | K |
| 91 | $CH_2CH_3$ | $NHCOCH_3$ | 1 | K |
| 92 | $CH_2COOCH_3$ | $NHCOCH_3$ | 1 | K |
| 93 | $CH_2CH_2OH$ | $NHCOCH_3$ | 1 | K |
| 94 | $CH_2CH_2OH$ | $NHCOCH_3$ | 2 | K |

TABLE 13

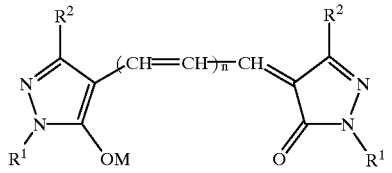

| | $R^1$ | $R^2$ | n | M |
|---|---|---|---|---|
| 95 | H | $NHCONHCH_3$ | 0 | K |
| 96 | H | $NHCONHCH_3$ | 1 | K |
| 97 | $CH_3$ | $NHCONHCH_3$ | 0 | K |
| 98 | $CH_3$ | $NHCONHCH_3$ | 1 | K |
| 99 | $CH_2CH_3$ | $NHCONHCH_3$ | 1 | K |

TABLE 14

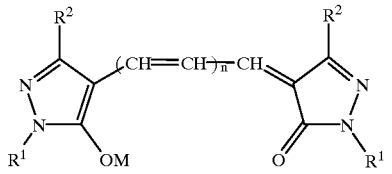

| | $R^1$ | $R^2$ | n | M |
|---|---|---|---|---|
| 100 | H | $NHCONHCH_3$ | 2 | K |
| 101 | H | $NHCON(CH_3)_2$ | 1 | K |
| 102 | $CH_3$ | $NHCONHCH_3$ | 2 | K |
| 103 | $CH_3$ | $NHCON(CH_3)_2$ | 2 | K |
| 104 | $CH_2CH_3$ | $NHCONHCH_3$ | 2 | K |

The dye used in the present invention can be dispersed on a molecular level in a light-sensitive layer or a light-insensitive layer according to various known methods. For example, a method wherein the dye is dispersed directly in a coating composition for a light-sensitive layer or a light-insensitive layer, or a method wherein the dye is dissolved in an appropriate solvent (e.g., methyl alcohol, ethyl alcohol, propyl alcohol, methyl cellosolve, a halogenated alcohol described in JP-A-48-9715 and U.S. Pat. No. 3,756,830, acetone, water, pyridine, or a mixture thereof) and added in the coating composition in the form of a solution. The dye according to the present invention diffuses almost uniformly throughout the layers constituting the photographic light-sensitive material at the coating of the layers no matter which of a light-sensitive layer and a light-insensitive layer it is added to.

The amount of the dye to be used is not particularly limited and preferably in a range of from 0.1 to 200 mg/m$^2$, more preferably in a range of form 1 to 100 mg/m$^2$.

In the silver halide color photographic light-sensitive material according to the present invention, various conventionally known photographic elements and additives can be employed.

For instance, a transmissive type support or reflective type support is used as the photographic support. Among the transmissive type support, a transparent film such as a cellulose triacetate film or a polyethylene terephthalate film, and a polyester film composed of 2,6-naphthalenedicarboxylic acid (NDCA) and ethylene glycol (EG) or composed of NDCA, terephthalic acid and EG and having a provided thereon an information recording layer such as a magnetic layer are preferably employed. For the purpose of the present invention, a reflective type support is preferred. Of the reflective type supports, a laminate composed of plural water-resistant resin layers such as polyethylene layers or polyester layers and containing a white pigment such as titanium oxide in at least one of the resin layers is particularly preferred.

It is more preferred that the water-resistant resin layer contains a fluorescent whitening agent. The fluorescent whitening agent may also be dispersed in a hydrophilic colloid layer of the photographic light-sensitive material. Preferred fluorescent whitening agents used include benzoxazole series, cumarin series and pyrazoline series compounds. Fluorescent whitening agents of benzoxazolyl naphthalene series and benzoxazolyl stilbene series are more preferably used. The amount of the fluorescent whitening agent to be used is not particularly limited and preferably in a range of from 1 to 100 mg/m$^2$. A mixing ratio of the fluorescent whitening agent to be used in the water-resistant resin layer is preferably from 0.0005 to 3% by weight, and more preferably from 0.001 to 0.5% by weight of the resin.

Further, a transmissive type support and the above-described reflective type support each having provided thereon a hydrophilic colloid layer containing a white pigment may be employed as the reflective type support.

With respect to the reflective type support, silver halide emulsion, heterogeneous metal ion to be doped in silver halide grain, stabilizer and antifoggant, chemical sensitization (chemical sensitizer), spectral sensitization (spectral sensitizer), cyan coupler, magenta coupler, yellow coupler, emulsified dispersion method of coupler, color image stabilizer (anti-staining agent, color fading preventing agent), dye (colored layer), gelation, layer construction of photographic material and pH of coated layer, those described in the patents shown in Tables 15 and 16 are preferably used in the present invention.

TABLE 15

| Photographic Element | JP-A-7-104448 | JP-A-7-77775 | JP-A-7-301895 |
|---|---|---|---|
| Reflective Type Support | Col. 7, line 12 to Col. 12, line 19 | Col. 35, line 43 to Col. 44, line 1 | Col. 5, line 40 to Col. 9, line 26 |
| Silver Halide Emulsion | Col. 72, line 29 to Col. 74, line 18 | Col. 44, line 36 to Col. 46, line 29 | Col. 77, line 48 to Col. 80, line 28 |
| Heterogeneous Metal Ion | Col. 74, lines 19 to 44 | Col. 46, line 30 to Col. 47, line 5 | Col. 80, line 29 to Col. 81, line 6 |
| Stabilizer and Antifoggant | Col. 75, lines 9 to 18 | Col. 47, lines 20 to 29 | Col. 18, line 11 to Col. 31, line 37 (particularly, mercapto heterocyclic compound) |
| Chemical Sensitization (Chemical Sensitizer) | Col. 74, line 45 to Col. 75, line 6 | Col. 47, lines 7 to 17 | Col. 81, lines 9 to 17 |
| Spectral Sensitization (Spectral Sensitizer) | Col. 75, line 19 to Col. 76, line 45 | Col. 47, line 30 to Col. 49, line 6 | Col. 81, line 21 to Col. 82, line 48 |
| Cyan Coupler | Col. 12, line 20 to Col. 39, line 49 | Col. 62, lines 50 to Col. 63, line 16 | Col. 88, line 49 to Col. 89, line 16 |
| Yellow Coupler | Col. 87, line 40 to Col. 88, line 3 | Col. 63, lines 17 to 30 | Col. 89, lines 17 to 30 |
| Magenta Coupler | Col. 89, lines 4 to 18 | Col. 63, line 31 to Col. 64, line 11 | Col. 32, line 34 to Col. 77, line 44 and Col. 88, lines 32 to 46 |

TABLE 16

| Photographic Element | JP-A-7-104448 | JP-A-7-77775 | JP-A-7-301895 |
|---|---|---|---|
| Emulsified Dispersion Method of Coupler | Col. 71, line 3 to Col. 72, line 11 | Col. 61, lines 36 to 49 | Col. 87, lines 35 to 48 |
| Color Image Stabilizer (Anti-staining Agent) | Col. 39, line 50 to Col. 70, line 9 | Col. 61, line 50 to Col. 62, line 49 | Col. 87, line 49 to Col. 88, line 48 |
| Color Fading Preventing Agent | Col. 70, line 10 to Col. 71, line 2 | | |
| Dye (Colored Layer) | Col. 77, line 42 to Col. 78, line 41 | Col. 7, line 14 to Col. 19, line 42 and Col. 50, line 3 to Col. 51, line 14 | Col. 9, line 27 to Col. 18, line 10 |
| Gelatin | Col. 78, lines 42 to 48 | Col. 51, lines 15 to 20 | Col. 83, lines 13 to 19 |
| Layer Construction of Photographic Material | Col. 39, lines 11 to 26 | Col. 44, lines 2 to 35 | Col. 31, line 38 to Col. 32, line 33 |
| pH of Coated Layer | Col. 72, lines 12 to 28 | | |
| Scanning Exposure | Col. 76, line 6 to Col. 77, line 41 | Col. 49, line 7 to Col. 50, line 2 | Col. 82, line 49 to Col. 83, line 12 |
| Preservative in Developing Solution | Col. 88, line 19 to Col. 89, line 22 | | |

The cyan couplers, magenta couplers and yellow couplers which can be suitably employed in the present invention also include those described in JP-A-62-215272, page 91, right upper column, line 4 to page 121, left upper column, line 6, JP-A-2-33144, page 3, right upper column, line 14 to page 18, left upper column, last line and page 30, right upper column, line 6 to page 35, right lower column, line 11, and EP-A-355660, page 4, lines 15 to 27, page 5, line 30 to page 28, last line, page 45, lines 29 to 31 and page 47, line 23 to page 63, line 50.

The bactericides and anti-mold agents described in JP-A-63-271247 are suitably used in the present invention.

The silver halide photographic light-sensitive material according to the present invention is suitable for a scanning exposure system using a cathode ray tube (CRT) in addition to a conventional printing system using a negative printer.

An exposure device using a cathode ray tube is simple, compact and low-cost in comparison with an exposure device using a laser beam. Also, the former is advantageous in view of easy control of an optical axis and color.

In the cathode ray tube used for the image exposure, various light emitting materials which emit light in the visible spectra are employed depending on the demand. For instance, a red light emitting material, a green light emitting material and a blue light emitting material are used individually or in combination of two or more thereof. The light emitting materials are not limited to those of red, green and blue described above, and other light emitting materials which emit yellow light, orange light, purple light or infrared light may also be utilized. Particularly, a cathode ray tube using a combination of these light emitting materials to emit white light is frequently employed.

When the photographic light-sensitive material having a plural of light-sensitive layers each having a different spectral sensitivity and the cathode ray tube having a plural of light emitting materials each emitting light having a different spectrum are used, a plural of color image signals are input to the cathode ray tube to emit the respective light and a plural of colors are exposed at once. Alternatively, a successive exposure method wherein each color light is emitted according to the input of the corresponding image signal, in order, and filters which cut color light other than the desired color light are used can be adopted. In general, the successive exposure method is preferred to obtain high quality images, since a cathode ray tube of high resolving power can be used.

The photographic light-sensitive material of the present invention can preferably be used in digital scanning exposure system using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, at least one of exposure light sources should be a semiconductor laser.

When such a scanning exposure light source is used, the spectral sensitivity maximum of the photographic light-sensitive material of the present invention can be appropriately set according to the wavelength of the scanning exposure light source to be used. As an oscillation wavelength of a laser can be made half using an SHG light source comprising a combination of non-linear optical crystal with a solid state laser using a semiconductor laser as an excitation light source or a semiconductor laser, blue light and green light can be obtained. Accordingly, it is possible to have the spectral sensitivity maximum of the photographic light-sensitive material in normal three regions of blue, green and red.

The exposure time in the scanning exposure is defined as the time necessary to expose the pixel size with the pixel density being 400 dpi, and preferred exposure time is not more than $10^{-4}$ second and more preferably not more than $10^{-6}$ second.

Preferred scanning exposure systems suitable for use in the present invention are described in detail in the patents set forth in the table shown above.

In order to process the silver halide photographic light-sensitive material of the present invention, processing elements and processing methods described in JP-A-2-207250, page 26, right lower column, line 1 to page 34, right upper column, line 9 and JP-A-4-97355, page 5, left upper column, line 17 to page 18, right lower column, line 20 are preferably employed. As preservatives in developing solution, the compounds described in the patent set forth in the table shown above are preferably employed.

A developing agent which can be used according to the present invention includes a hydrazine type developing agent (color forming reducing agent) as well as a conventional aromatic primary amine type developing agent. Specifically, hydrazine compounds described in Japanese Patent Application Nos. 7-334190, 7-334192, 7-334197 and 7-344396, and JP-A-8-234388 are preferably employed.

As a developing process using such a developing agent, a wet type developing process, for example, a conventional developing method using a developing solution containing an alkaline agent and the developing agent and an activator method in which a photographic light-sensitive material containing the developing agent is developed with an activator solution such as an alkaline solution containing no developing agent, as well as a dry type developing method without using a processing solution, for example, a heat developing method can be employed.

When the activator method is adopted, a developing method wherein the photographic light-sensitive material having a reduced coating amount of silver is subjected to an image amplification process (intensification process) using hydrogen peroxide is preferably employed. Specifically, an image forming method using the activator solution containing hydrogen peroxide as described in Japanese Patent Application Nos. 7-63587 and 7-334202 is preferably employed.

The silver halide color photographic light-sensitive material according to the present invention is excellent in rapid processing suitability, provides a color image having excellent image quality and sharpness, and is suitable for scanning exposure using a semiconductor laser as a light source. The present invention also provides a method of forming a color image using the silver halide color photographic light-sensitive material upon a rapid processing having less dependence on processing conditions.

The present invention will be explained in greater detail with reference to the following examples, but the present invention should not be construed as being limited thereto.

EXAMPLE 1

Preparation of Emulsion Em R1

An aqueous solution of gelatin (containing 1.2 liters of water, 20 g of deionized alkali-treated gelatin (hereinafter referred to as EA-Gel) and 0.8 g of NaCl, pH 6.0) was placed in a reaction vessel. An Ag-1 solution and an X-1 solution were concurrently added and mixed at 50 ml/minute for 15 seconds at a temperature of 48° C. with stirring.

The Ag-1 solution contains 20 g of $AgNO_3$, 0.6 g of low molecular weight gelatin having an average molecular weight of 20,000 (hereinafter referred to as 2M-Gel) and 0.2 ml of aqueous $HNO_3$ (1N) solution per 100 ml of water, and the X-1 solution contains 7 g of NaCl and 0.6 g of 2M-Gel per 100 ml of water.

Then, an Ag-2 solution (containing 4 g of $AgNO_3$, 0.6 g of 2M-Gel and 0.2 ml of aqueous $HNO_3$ (1N) solution per 100 ml of water) and an X-2 solution (containing 2.8 g of KBr and 0.6 g of 2M-Gel per 100 ml of water) were concurrently added and mixed at 70 ml/minute for 15 seconds. Then, the Ag-1 solution and the X-1 solution were concurrently added and mixed at 25 ml/minute for 2 minutes. An aqueous solution of NaCl (0.1 g/ml) was added in an amount of 15 ml, the temperature was raised to 70° C. followed by ripening for 5 minutes, and the Ag-1 solution and the X-1 solution were concurrently added and mixed at 10 ml/minute for 15 minutes. Then, an emulsion of fine AgCl grains having a mean grain size of 0.07 $\mu$m, 0.1% or less of which grains are occupied by twin grains or grains containing screw dislocations was added in an amount of 0.2 mol, followed by ripening for 15 minutes. The temperature was lowered to 40° C., and the pH was adjusted to 2.0. After stirring for 20 minutes, the pH was adjusted to 5.2, and $8.4\times10^{-2}$ mol/l of a KBr-1 solution (containing 1 g of KBr per 100 ml of water) was added, followed by stirring for 5 minutes. Then, after addition of Sensitizing Dyes G and H shown below, a flocculating agent was added, and the emulsion was washed with water according to a conventional method. To the emulsion were added a sulfur sensitizing agent and a gold sensitizing agent to conduct optimal gold surfer sensitization. The observation of the emulsion thus obtained under an electron microscope revealed that right-angled parallelogrammic tabular grains having (100) faces as major faces and an aspect ratio of 3 or more accounted for 80% of the total projected area of silver halide grains. The tabular grains had a mean grain size of 1.05 $\mu$m, a mean aspect ratio of 7.0 and a mean grain volume of 0.13 $\mu m^3$. Further, the coefficient of variation of the grain size distribution of the tabular grains was 0.25. Moreover, potassium hexachloroiridate(IV) in the total amount of 0.3 mg and potassium ferrocyanide in the total amount of 1.5 mg, respectively, per mol of the silver were contained in the inside and on the surface of the grains.

Preparation of Emulsion Em G1

Emulsion Em G1 was preferred in the same manner as in the preparation of Emulsion Em R1 except for using Sensitizing Dyes D, E and F shown below in place of Sensitizing Dyes G and H.

Preparation of Emulsion Em B1

Emulsion Em B1 was prepared in the same manner as in the preparation of Emulsion Em R1 except for changing the temperature for preparation of first silver chloride nuclei from 48° C. to 60° C. and using Sensitizing Dyes A, B and C shown below in place of Sensitizing Dyes G and H. The observation of the emulsion thus obtained under an electron microscope revealed that right-angled parallelogrammic tabular grains having (100) faces as major faces and an aspect ratio of 3 or more accounted for 80% of the total projected area of silver halide grains. The tabular grains had a mean grain size of 1.35 $\mu$m, a mean aspect ratio of 6.5 and a mean grain volume of 0.32 $\mu m^3$. Further, the coefficient of variation of the grain size distribution of the tabular grains was 0.20.

Preparation of Emulsion Em $R_2$

An aqueous solution of gelatin (containing 1.2 liters of water, 20 g of deionized alkali-treated gelatin (hereinafter referred to as EA-Gel) and 0.8 g of NaCl, pH 6.0) was placed in a reaction vessel. An Ag-1 solution and an X-1 solution were concurrently added and mixed at 50 ml/minute for 15 seconds at a temperature of 48° C. with stirring.

The Ag-1 solution contains 20 g of $AgNO_3$, 0.6 g of low molecular weight gelatin having an average molecular weight of 20,000 (hereinafter referred to as 2M-Gel) and 0.2 ml of aqueous $HNO_3$ (1N) solution per 100 ml of water, and the X-1 solution contains 7 g of NaCl and 0.6 g of 2M-Gel per 100 ml of water.

Then, an Ag-2 solution (containing 4 g of $AgNO_3$, 0.6 g of 2M-Gel and 0.2 ml of aqueous $HNO_3$ (1N) solution per 100 ml of water) and an X-2 solution (containing 1.3 g of NaCl, 0.3 g of KI and 0.6 g of 2M-Gel per 100 ml of water) were concurrently added and mixed at 70 ml/minute for 15 seconds. Then, the Ag-1 solution and the X-1 solution were concurrently added and mixed at 25 ml/minute for 2 minutes. An aqueous solution of NaCl (0.1 g/ml) was added in an amount of 15 ml, the temperature was raised to 70° C. followed by ripening for 5 minutes, and the Ag-1 solution and the X-1 solution were concurrently added and mixed at 10 ml/minute for 15 minutes. Then, an emulsion of fine AgCl grains having a mean grain size of 0.07 $\mu$m, 0.1% or less of which grains are occupied by twin grains or grains containing screw dislocations was added in an amount of 0.2 mol, followed by ripening for 15 minutes. The temperature was lowered to 40° C., and the pH was adjusted to 2.0. After stirring for 20 minutes, the pH was adjusted to 5.2, and $8.4\times10^{-2}$ mol/l of a KBr-1 solution (containing 1 g of KBr per 100 ml of water) was added, followed by stirring for 5 minutes. Then, after addition of Sensitizing Dyes G and H shown below, a flocculating agent was added, and the emulsion was washed with water according to a conventional method. To the emulsion were added a sulfur sensitizing agent and a gold sensitizing agent to conduct optimal gold surfer sensitization. The observation of the emulsion thus obtained under an electron microscope revealed that right-angled parallelogrammic tabular grains having (100) faces as major faces and an aspect ratio of 3 or more accounted for 65% of the total projected area of silver halide grains. The tabular grains had a mean grain size of 1.10 μm, a mean aspect ratio of 8.0 and a mean grain volume of 0.13 $\mu m^3$. Further, the coefficient of variation of the grain size distribution of the tabular grains was 0.20.

Emulsion Em R2 wherein I ion was used in the formation of nuclei had a low ratio of tabular grain in comparison with Emulsions Em R1, Em G1 and Em B1.

Preparation of Support A 30 wt % of titanium dioxide was added to a low density polyethylene having MFR of 3, 3.0 wt % of zinc stearate based on the amount of the titanium dioxide was added thereto, the mixture was kneaded in a Banbury mixer. The size of the titanium dioxide used was confirmed to be from 0.15 μm to 0.35 μm under the observation using an electron microscope, and the titanium dioxide was coated with aluminum oxide hydrate in an amount of 0.75 wt % based on titanium dioxide in the form of $Al_2O_3$.

After a paper substrate having a basis weight of 170 $g/m^2$ was corona discharged at 10 kVA, the above-described polyethylene composition containing 30 wt % of titanium dioxide and a polyethylene composition containing an ultramarine (DV-1 manufactured by Dai-ichi Kasei Kogyo K.K.) but no titanium dioxide were melt-extruded at 320° C. using a multilayer extrusion coating die to form a polyethylene laminate layer composed of a 18 μm thick upper layer (titanium dioxide content: 30%) and a 15 μm thick lower layer (titanium dioxide content: 0%) on the paper substrate. The surface of the polyethylene layer was then subjected to a glow discharge treatment.

Preparation of Light-Sensitive Material (Sample 101)

The above-described reflective support was coated with various photographic constituent layers to prepare a multilayer color printing paper having the following layer structure. The resulting color printing paper was designated sample 101. Coating solution for the layers were prepared as follows.

Preparation of Coating Solution for Fifth Layer 10 g of Cyan Coupler (1) and various additives shown below were dissolved in 30 g of Solvent (Solv-8) and 50 ml of ethyl acetate and the solution was emulsified and dispersed in 400 g of a 12% aqueous gelatin solution containing 1.2 g of Surface Active Agent (Cpd-12) to prepare an emulsified dispersion of the cyan coupler designated Emulsified Dispersion C having an average particle size of 0.18 μm.

Separately, Silver Chlorobromide Emulsion R was prepared (a cubic form, a mixture in a ratio of ¼ (silver mol ratio) of a large grain size emulsion having an average grain size of 0.50 μm and a small grain size emulsion having an average grain size of 0.41 μm, variation coefficients of the grain size distribution were 0.09 and 0.11, respectively, both of them being composed of silver chloride substrate grains having 0.2 mol % of silver bromide localized in a part of their surface, and containing potassium hexachloro-iridate (IV) in the total amount of 0.1 mg and potassium ferrocyanide in the total amount of 1.0 mg, respectively, per mol of silver in the inside and the silver bromide localized phase of the grains). The red-sensitive Sensitizing Dyes G and H shown below were added each in an amount of $5.0\times10^{-5}$ mol per mol of silver to the large grain size emulsion, and each in an amount of $8.0\times10^{-5}$ mol per mol of silver to the small grain size emulsion. Further, additive X shown below was added in an amount of $2.6\times10^{-3}$ mol per mol of silver halide. The silver chlorobromide emulsion was subjected optimally to chemical sensitization by adding a sulfur sensitizer and a gold sensitizer.

Emulsified Dispersion C described above was mixed with Silver Chlorobromide Emulsion R and the mixture was dissolved to prepare a coating solution for the fifth layer having the composition shown below. A coating amount of the silver halide emulsion is indicated by the coating amount in terms of silver.

The coating solutions for the first to seventh layers other than the fifth layer were prepared in the same manner as the coating solution for the fifth layer. 1-Oxy-3,5-dichloro-s-triazine sodium salt was used as a gelatin hardening agent in each layer.

Further, AS-1, AS-2, AS-3 and AS-4 shown below were added to each layer so that the total coating amount became 15.0 $mg/m^2$, 6.0 $mg/m^2$, 5.0 $mg/m^2$ and 10.0 $mg/m^2$, respectively.

The cubic silver chlorobromide emulsion used in each light-sensitive emulsion layer was prepared in the same manner as for Silver Chlorobromide Emulsion R described above while appropriately adjusting the grain size of large grain size emulsion and small grain size emulsion. The spectral sensitizing dyes used for the silver chlorobromide emulsions are shown below.

Sensitizing Dyes for Blue-Sensitive Emulsion Layer:

Sensitizing Dye A

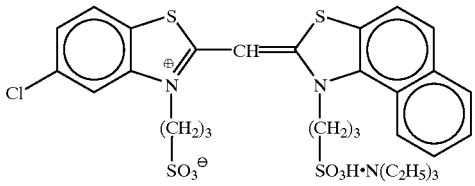

Sensitizing Dye B

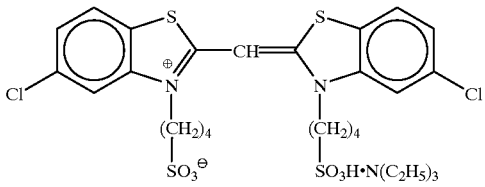

Sensitizing Dye C

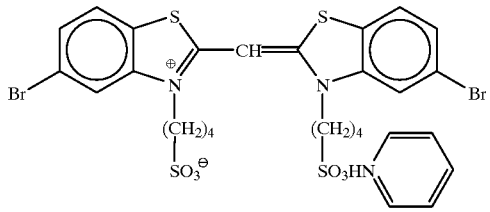

(each in an amount of $1.4\times10^{-4}$ mol per mol of the silver halide to the large grain size emulsion, and each in an amount of $1.7\times10^{-4}$ mol per mol of the silver halide to the small grain size emulsion)

Sensitizing Dyes for Green-Sensitive Emulsion Layer:

Sensitizing Dye D

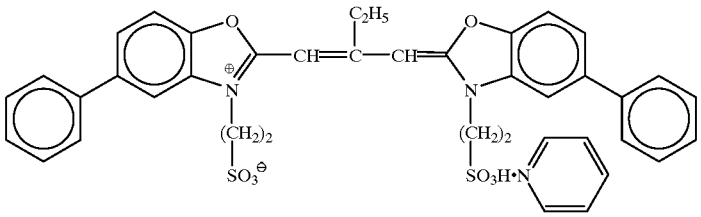

Sensitizing Dye E

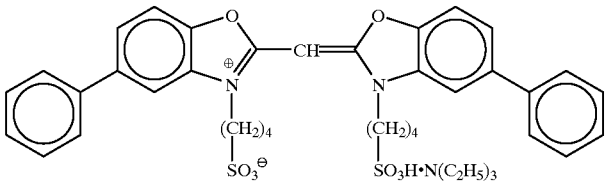

Sensitizing Dye F

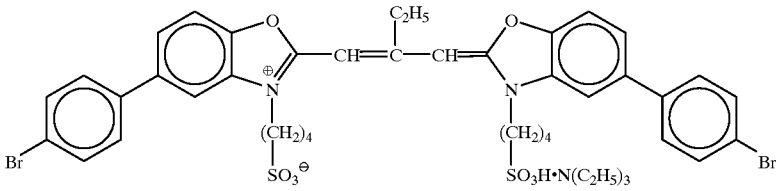

(Sensitizing Dye D was used in an amount of 3.0×10 mol per mol of the silver halide for the large grain size emulsion and in an amount of $3.6\times10^{-4}$ mol per mol of the silver halide for the small grain size emulsion; Sensitizing Dye E was used in an amount of $4.0\times10^{-5}$ mol per mol of the silver halide for the large grain size emulsion and in an amount of $7.0\times10^{-5}$ mol per mol of the silver halide for the small grain size emulsion; and Sensitizing Dye F was used in an amount of $2.0\times10^{-4}$ mol per mol of the silver halide for the large grain size emulsion and in an amount of $2.8\times10^{-4}$ mol per mol of the silver halide for the small grain size emulsion)

Sensitizing Dyes for Red-Sensitive Emulsion Layer:

Sensitizing Dye G

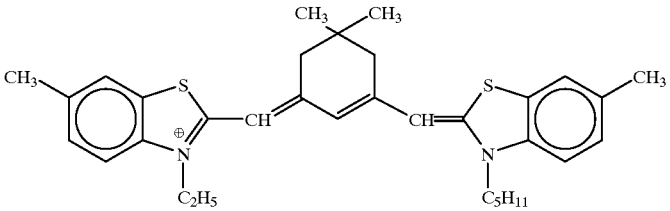

Sensitizing Dye E

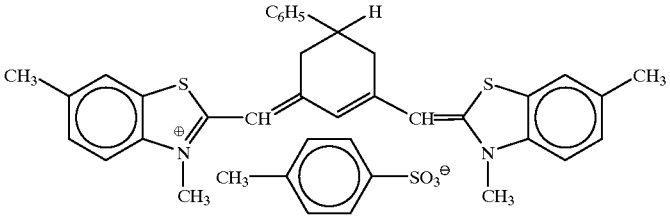

(Sensitizing Dye G was used in an amount of $5.0\times10^{-5}$ mol per mol of the silver halide for the large grain size emulsion and in an amount of $8.0\times10^{-5}$ mol per mol of the silver halide for the small grain size emulsion; and Sensitizing Dye H was used in an amount of $5.0\times10^{-5}$ mol per mol of the silver halide for the large grain size emulsion and in an amount of $8.0\times10^{-5}$ mol per mol of the silver halide for the small grain size emulsion)

Compound X

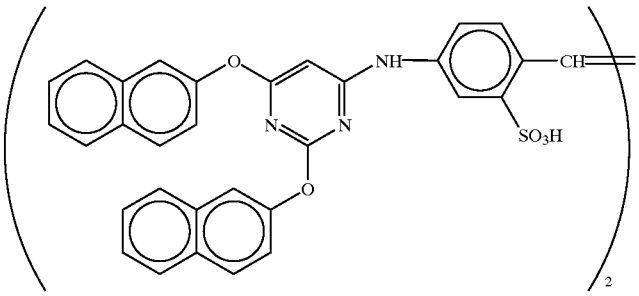

Further, 1-(5-methylureidophenyl)-5-mercapto-tetrazole was added to the blue-sensitive emulsion layer, the green-sensitive emulsion layer and the red-sensitive emulsion layer in an amount of $8.5\times10^{-4}$ mol, $3.0\times10^{-3}$ mol and $2.5\times10^{-4}$ mol, respectively, per mol of the silver halide.

In addition, 4-hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mol of the silver halide.

Moreover, the following dyes each was added separately to the second, fourth and sixth layers as irradiation preventing dyes.

Magenta Dye

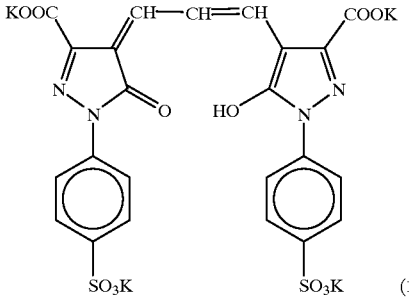

(10 mg/m$^2$)

Yellow Dye

A mixture of

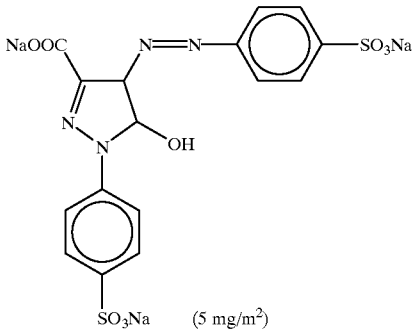

(5 mg/m$^2$)

and Dye 1 of the present invention (5 mg/m$^2$)

-continued

Cyan Dye

A mixture of

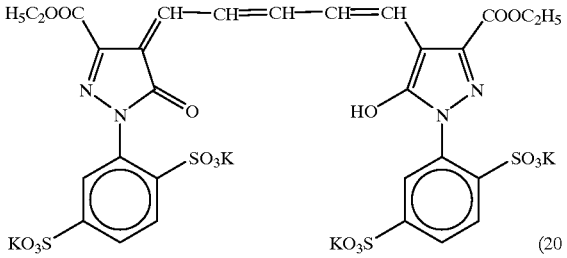

(20 mg/m$^2$)

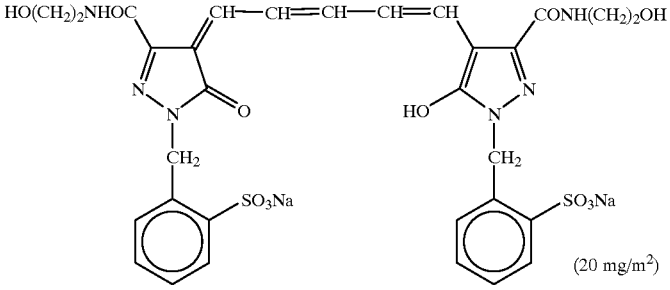

and (20 mg/m$^2$)

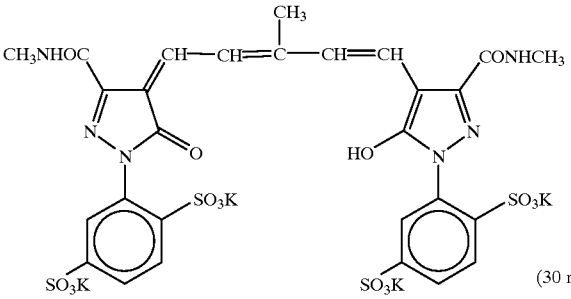

(30 mg/m$^2$)

Layer Construction

The composition of each layer is described below. The numeral represents the coating amount (g/m$^2$). The numeral for silver halide emulsion represents the coating amount in terms of silver.

Support A

| Polyethylene-laminated paper containing a bluish dye (ultramarine) in the polyethylene laminated layer on the side of the first layer | |
|---|---|
| First Layer (blue-sensitive emulsion layer) | |
| Silver Chlorobromide Emulsion Em B1 | 0.27 |
| Gelatin | 1.22 |
| Yellow Coupler (ExY) | 0.64 |
| Color Image Stabilizer (Cpd-1) | 0.08 |
| Color Image Stabilizer (Cpd-2) | 0.04 |
| Color Image Stabilizer (Cpd-3) | 0.08 |
| Color Image Stabilizer (Cpd-5) | 0.02 |
| Color Image Stabilizer (Cpd-9) | 0.01 |
| Solvent (Solv-1) | 0.11 |
| Solvent (Solv-6) | 0.11 |
| Second Layer (color mixing preventing layer) | |
| Gelatin | 0.90 |
| Color Mixing Preventing Agent (Cpd-4) | 0.11 |
| Solvent (Solv-2) | 0.22 |

-continued

| Polyethylene-laminated paper containing a bluish dye (ultramarine) in the polyethylene laminated layer on the side of the first layer | |
|---|---|
| Solvent (Solv-3) | 0.08 |
| Solvent (Solv-7) | 0.01 |
| Color Image Stabilizer (Cpd-4) | 0.14 |
| Third Layer (green-sensitive emulsion layer) | |
| Silver Chlorobromide Emulsion Em G1 | 0.11 |
| Gelatin | 1.30 |
| Magenta Coupler (ExM) | 0.13 |
| Ultraviolet Absorber (UV-A) | 0.12 |
| Color Image Stabilizer (Cpd-2) | 0.01 |
| Color Image Stabilizer (Cpd-5) | 0.02 |
| Color Image Stabilizer (Cpd-6) | 0.01 |
| Color Image Stabilizer (Cpd-7) | 0.08 |
| Color Image Stabilizer (Cpd-8) | 0.03 |
| Color Image Stabilizer (Cpd-10) | 0.01 |
| Solvent (Solv-8) | 0.15 |
| Solvent (Solv-4) | 0.22 |
| Solvent (Solv-5) | 0.11 |
| Fourth Layer (color mixing preventing layer) | |
| Gelatin | 0.68 |
| Color Mixing Preventing Agent (Cpd-4) | 0.11 |
| Solvent (Solv-1) | 0.07 |
| Solvent (Solv-2) | 0.22 |
| Solvent (Solv-7) | 0.01 |
| Color Image Stabilizer (Cpd-7) | 0.14 |

-continued

| Polyethylene-laminated paper containing a bluish dye (ultramarine) in the polyethylene laminated layer on the side of the first layer | |
|---|---|
| Fifth Layer (red-sensitive emulsion layer) | |
| Silver chlorobromide Emulsion R | 0.09 |
| Gelatin | 0.99 |
| Cyan Coupler (1) | 0.15 |
| Color Image Stabilizer (Cpd-6) | 0.01 |
| Color Image Stabilizer (Cpd-8) | 0.01 |
| Solvent (Solv-3) | 0.08 |
| Solvent (Solv-8) | 0.44 |
| Sixth Layer (ultraviolet absorbing layer) | |
| Gelatin | 0.48 |
| Ultraviolet Absorber (UV-C) | 0.35 |
| Color Image Stabilizer (Cpd-5) | 0.01 |
| Color Image Stabilizer (Cpd-7) | 0.05 |
| Solvent (Solv-9) | 0.05 |
| Seventh Layer (protective layer) | |
| Gelatin | 0.90 |
| Acryl-Modified Copolymer of Polyvinyl Alcohol (modification degree: 17%) | 0.05 |
| Liquid Paraffin | 0.02 |
| Color Image Stabilizer (Cpd-11) | 0.02 |

The compounds used for preparing the composition of each layer described above are shown below.

(ExY) Yellow Coupler

1/1/1 mixture by mol ratio of (ExY-1)

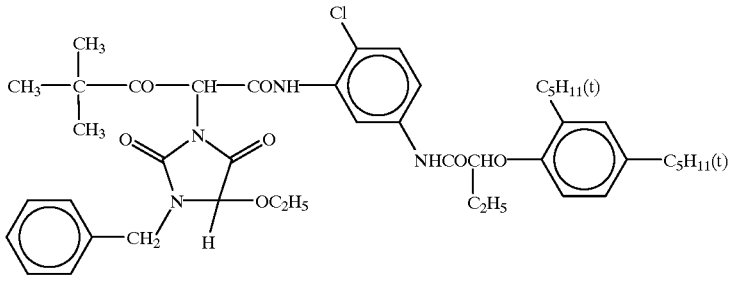

(ExY-2)

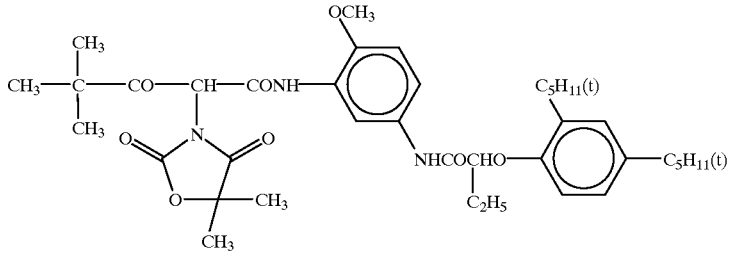

-continued
and
(ExY-3)
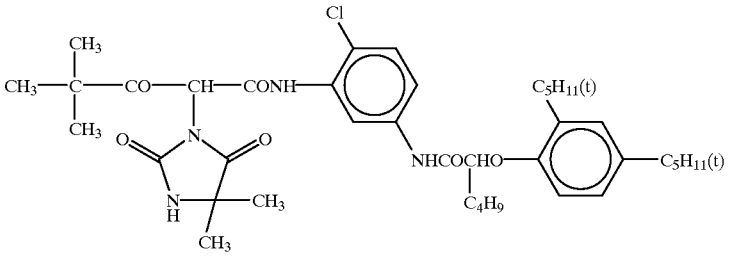
(ExM) Magenta Coupler
1/5 mixture by mol ratio of
(ExM-1)
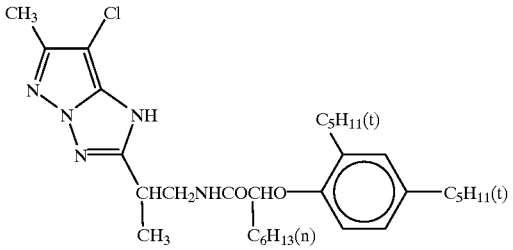
and
(ExM-2)
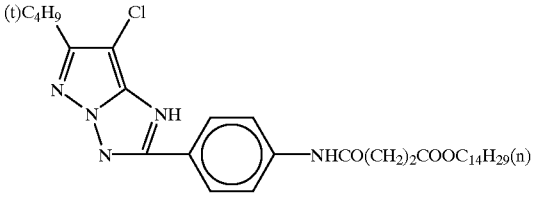
(Cpd-1) Coupler Image Stabilizer
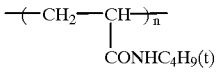
number average molecular weight : 60,000
(Cpd-2) Color Image Stabilizer
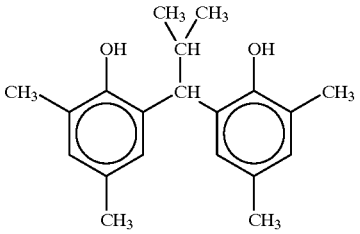
(Cpd-3) Color Image Stabilizer
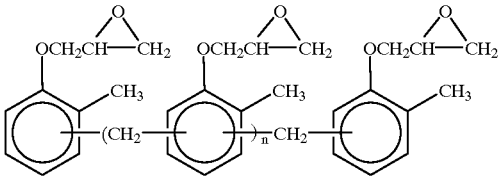
(n = 0 to 15; average value = 7 to 8)

-continued
(Cpd-4) Color Mixing Preventing Agent
1/1/1 mixture by weight ratio of
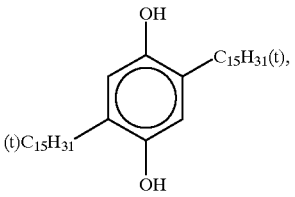
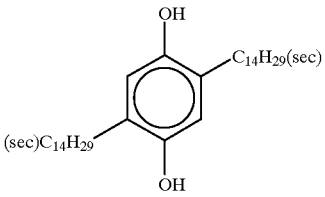
and
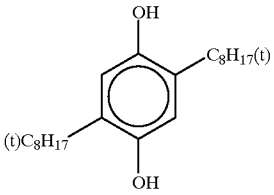
(Cpd-5) Color Image Stabilizer
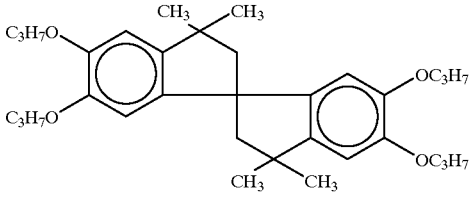
(Cpd-6) Color Image Stabilizer
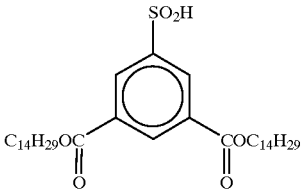
(Cpd-7) Color Image Stabilizer
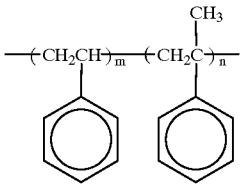
number average molecular weight: 600
m/n = 10/90
(Cpd-8) Color Image Stabilizer
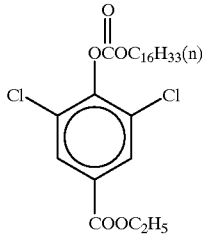

-continued
(Cpd-9) Color Image Stabilizer
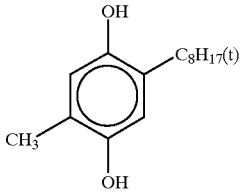
(Cpd-10) Color Image Stabilizer
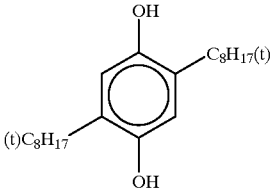
(Cpd-11) Surface Active Agent
3/1/3 mixture by weight ratio of (1), (2) and (3)
(1)
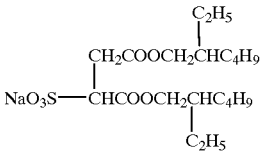
(2)
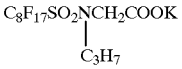
(3)
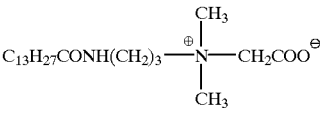
(Cpd-12) Surface Active Agent
1/1 mixture by weight ratio of (1) and (2)
(1)
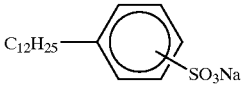
(2)
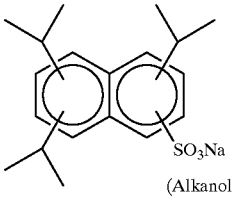
(Alkanol XC)
(Solv-1) Solvent
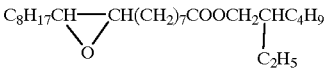
(Solv-2) Solvent
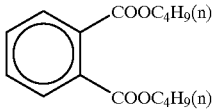

-continued
(Solv-3) Solvent
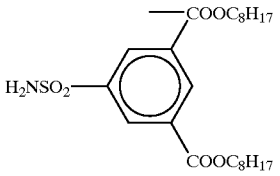
(Solv-4) Solvent
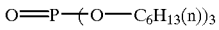
(Solv-5) Solvent
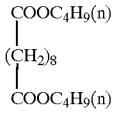
(Solv-6) Solvent
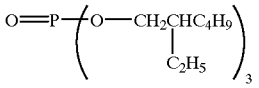
(Solv-7) Solvent
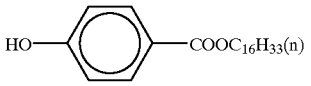
(Solv-8) Solvent
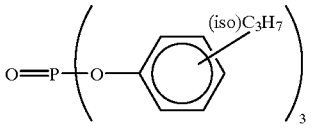
(Solv-9) Solvent
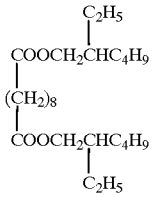
(UV-A) Ultraviolet Absorber
5/2/2/1 mixture by weight ratio of (1), (2), (3) and (4)
(1)
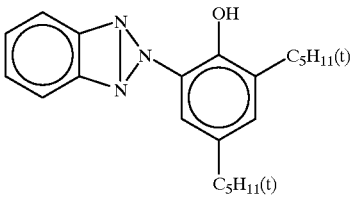
(2)
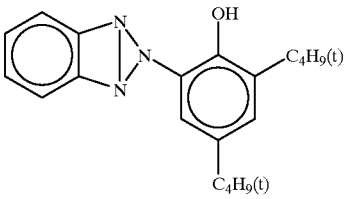

-continued
(3)
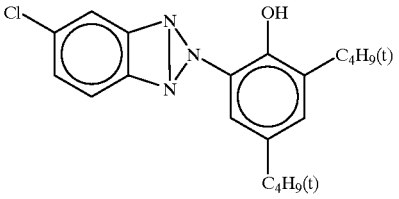
(4)
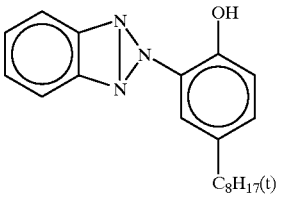
(UV-C) Ultraviolet Absorber
6/2/2/2/3/1 mixture by weight ratio of (1), (2), (3), (4), (5) and (6)
(1)
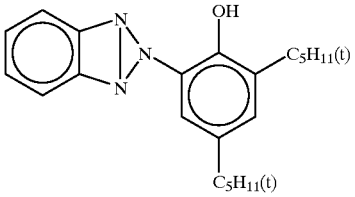
(2)
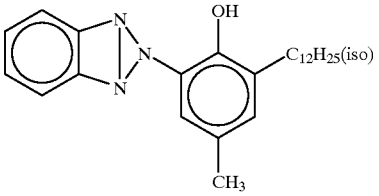
(3)
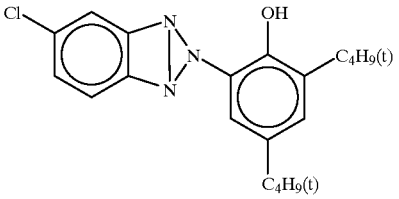
(4)
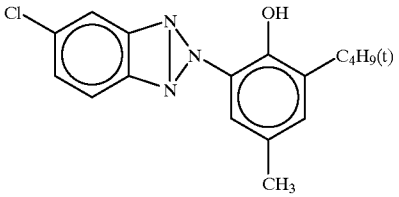
(5)
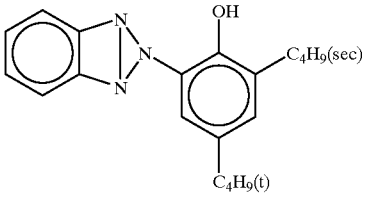
(6)
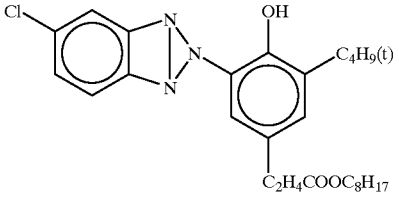
(AS-1) Preservative
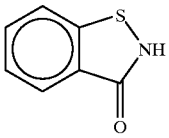
(AS-2) Preservative
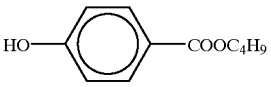

-continued (AS-3) Preservative

1/1/1/1 mixture by weight ratio of a, b, c and d

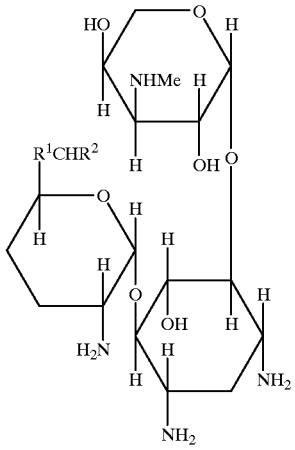

| | $R^1$ | $R^2$ |
|---|---|---|
| a | —Me | —NHMe |
| b | —Me | —$NH_2$ |
| c | —H | —$NH_2$ |
| d | —H | —NHMe |

(AS-4) Preservative

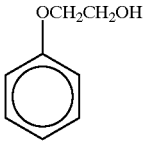

Sample (111) was prepared in the same manner as in the preparation of Sample (101) described above expect for changing the fifth layer (red-sensitive emulsion layer) to the following.

| Fifth Layer (red-sensitive emulsion layer) | |
|---|---|
| Silver Chlorobromide Emulsion R | 0.18 |
| Gelatin | 0.80 |
| Cyan coupler (ExC) | 0.33 |
| Ultraviolet Absorber (UV-2) | 0.18 |

-continued

| Fifth Layer (red-sensitive emulsion layer) | |
|---|---|
| Dye Image Stabilizer (Cpd-1) | 0.33 |
| Dye Image Stabilizer (Cpd-2) | 0.03 |
| Dye Image Stabilizer (Cpd-6) | 0.01 |
| Dye Image Stabilizer (Cpd-8) | 0.01 |
| Dye Image Stabilizer (Cpd-9) | 0.02 |
| Dye Image Stabilizer (Cpd-10) | 0.01 |
| Solvent (Solv-8) | 0.44 |

(UV-2) Ultraviolet Absorber

5/2/2/2 mixture by weight ratio of (1), (2), (3) and (4)

(1)

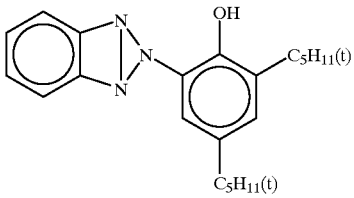

(2)

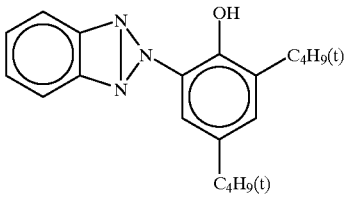

-continued (3)

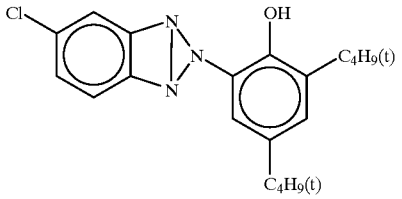

(4)

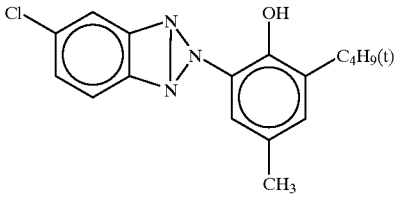

(ExC) Cyan Coupler

1/3 mixture by mol ratio of

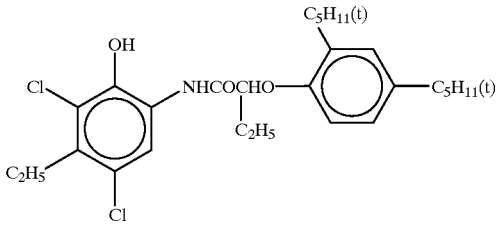

and

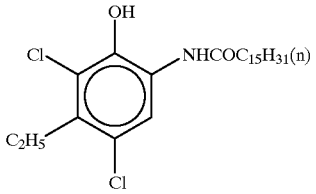

Samples 102 to 110 and 112 to 113 were prepared in the same manner as in Samples 101 and 111 described above except for changing the silver halide emulsion and the cyan coupler as shown in Table 17 below, respectively.

TABLE 17

| Sample No. | Emulsion of Fifth Layer | Cyan Coupler | ΔD | Remarks |
|---|---|---|---|---|
| 101 | R | Coupler (1) | −0.21 | Comparison |
| 102 | Em R1 | " | −0.06 | Present Invention |
| 103 | Em R2 | " | −0.08 | Present Invention |
| 104 | R | Comparative Coupler 1 | −0.20 | Comparison |

TABLE 17-continued

| Sample No. | Emulsion of Fifth Layer | Cyan Coupler | ΔD | Remarks |
|---|---|---|---|---|
| 105 | Em R1 | Comparative Coupler 1 | −0.19 | " |
| 106 | Em R1 | Comparative Coupler 2 | −0.19 | " |
| 107 | R | Coupler (26) | −0.18 | " |
| 108 | Em R1 | " | −0.06 | Present Invention |
| 109 | R | Coupler (31) | −0.19 | Comparison |
| 110 | Em R2 | " | −0.05 | Present Invention |
| 111 | R | ExC | −0.21 | Comparison |
| 112 | Em R1 | " | −0.20 | " |
| 113 | Em R2 | " | −0.18 | " |

Comparative Coupler 1

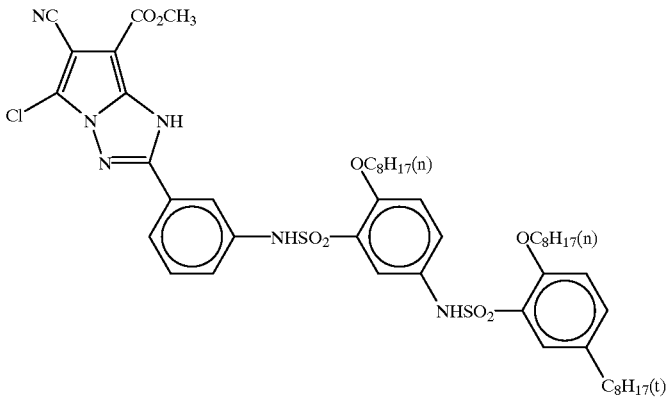

Compound (3) described in JP-A-5-204110

Comparative Coupler 2

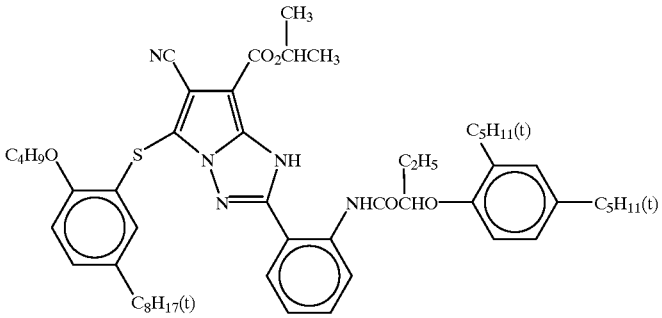

Compound (19) described in JP-A-5-204110

Using each of the photographic light-sensitive material samples thus prepared in which a hardening reaction had been terminated, the following evaluation was conducted. Specifically, each of Samples 101 to 110 and 111 to 113 was continuously processed in a proportion of 25% of the sample exposed to white light and 75% of the unexposed sample using a separate color developing solution having the same composition under the conditions shown below.

| Processing Step | Processing Temperature (° C.) | Processing Time (sec) | Replenishment Rate* (ml) | Tank Capacity (ml) |
|---|---|---|---|---|
| Color Development | 38.5 | 45 | 73 | 500 |
| Bleach-Fixing | 30–35 | 45 | 60 | 500 |
| Rinsing (1) | 30–35 | 20 | | 500 |
| Rinsing (2) | 30–35 | 20 | | 500 |
| Rinsing (3) | 30–35 | 20 | 370 | 500 |
| Drying | 70–80 | 60 | | |

*Replenishment rate per $m^2$ of the photographic material

Rinsing was conducted in a 3-tank countercurrent system from rinsing (3) to rinsing (1).

The composition of each processing solution was as follows

| Color Developing Solution | Tank Solution | Replenisher |
|---|---|---|
| Water | 700 ml | 700 ml |
| Sodium Triisopropylene(β)-sulfonate | 0.1 g | 0.1 g |
| Ethylenediaminetetraacetic Acid | 3.0 g | 3.0 g |
| Disodium 1,2-dihydroxybenzene-4,6-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium Carbonate | 27.0 g | 27.0 g |
| Fluorescent Whitening Agent (WHITEX 4, manufactured by Sumitomo Chemical Co., Ltd.) | 1.0 g | 3.0 g |
| Sodium Sulfite | 0.1 g | 0.1 g |
| Disodium-N,N-bis(sulfonato-ethyl)hydroxylamine | 10.0 g | 13.0 g |
| N-Ethyl-N-(β-methanesulfon-amidoethyl)-3-methyl-4-amino-aniline Sulfate | 5.0 g | 11.5 g |
| Water to make | 1,000 ml | 1,000 ml |
| pH (25° C.) | 10.0 | 11.0 |

-continued

| The composition of each processing solution was as follows | |
|---|---|
| Bleach-Fixing Solution (tank solution and replenisher are the same) | |
| Water | 600 ml |
| Ammonium Thiosulfate (700 g/liter) | 100 ml |
| Ammonium Sulfite | 40 g |
| Ammonium Ethylenediaminetetraacetato Ferrate | 55 g |
| Disodium Ethylenediaminetetraacetate | 5 g |
| Ammonium Bromide | 40 g |
| Nitric Acid (67%) | 30 g |
| Water to make | 1,000 ml |
| pH (25° C.) (adjusted with acetic acid and aqueous ammonia) | 5.8 |

Rinsing Solution (tank solution and replenisher are the same) Ion Exchange Water (each concentration of calcium and magnesium is 3 ppm or less)

Development processing of each sample was conducted with the fresh developer before the continuous processing or with the exhausted developer after the continuous processing, and then sensitometry of each developed sample was conducted. Development processing was conducted after each sample was exposed using a sensitometer (FWH type, color temperature of a light source: 3,200° K., manufactured by Fuji Photo Film Co., Ltd.) through a color separation filter and a gradation wedge.

The cyan density D(cyan) of the sample exposed at the exposure at which the sample provided a cyan density of 2.0 when the sample was processed with the fresh developer (Fr) before the running test and then processed with the exhausted developer (Run) after the running test was measured to obtain the density change [(ΔD(Run-Fr)=D(cyan)−2.0]. The greater the absolute value of the density change, the greater the dependence of the change in photographic properties on continuous processing conditions. The results obtained are shown in Table 17 above.

From the results shown in Table 17, it can be seen that the reduction in cyan density due to the continuous processing can be particularly restrained by the use of the photographic light-sensitive material of the present invention comprising the emulsion containing high silver chloride content tabular grains and the cyan coupler represented by the formula (I).

EXAMPLE 2

Samples 201 to 213 were prepared in the same manner as in the preparation of Samples 101 to 113, except for using Dye 11 according to the present invention in place of Magenta Dye. Using these samples, the evaluation was conducted in the same manner as in Example 1. The results obtained are shown in Table 18 below.

TABLE 18

| Sample No. | ΔD | Remarks |
|---|---|---|
| 201 | −0.21 | Comparison |
| 202 | −0.04 | Present Invention |
| 203 | −0.05 | Present Invention |
| 204 | −0.21 | Comparison |
| 205 | −0.20 | Comparison |
| 206 | −0.19 | Comparison |
| 207 | −0.19 | Comparison |
| 208 | −0.04 | Present Invention |
| 209 | −0.20 | Comparison |
| 210 | −0.03 | Present Invention |
| 211 | −0.20 | Comparison |
| 212 | −0.20 | Comparison |
| 213 | −0.19 | Comparison |

From the results shown in Table 18, it can be seen that the reduction in cyan density due to the continuous processing can be further particularly restrained by using the water-soluble dye represented by the formula (IX).

EXAMPLE 3

Light-sensitive materials prepared in Examples 1 and 2 were evaluated in the same manner as in Example 1, except that exposure was carried out as follows. The results obtained were similar to those obtained in Examples 1 and 2.

Exposure (1) Laser light having a wavelength of 473 nm which was obtained form a YAG solid laser (oscillation wavelength: 946 nm) using a semiconductor laser GaAlAs (oscillation wavelength: 808.5 nm) as an exciting light source by wavelength conversion through an SHG crystal of $KNbO_3$, (2) laser light having a wavelength of 532 nm which was obtained from a $YVO_4$ solid laser (oscillation wavelength: 1064 nm) using a semiconductor laser GaAlAs (oscillation wavelength: 808.7 nm) as an exciting light source by wavelength conversion through an SHG crystal of KTP, or (3) laser light of an AlGaInP laser (oscillation wavelength: about 670 nm; Type No. TOLD9211 manufactured by Toshiba Corporation) was used as a light source of laser scanning exposure system. The color printing paper was moved in the direction vertical to the scanning direction and subjected to scanning exposure successively to a laser beam by means of a rotating polyhedron. The relationship between the density (D) of the light-sensitive material and the exposure (E), D-logE, was obtained, and gradation exposure was conducted on the basis of the relationship. The quantity of laser light having a wavelength of 473 nm or 532 nm was varied by using an outer modulator to control the exposure, and that of laser light having a wavelength of 670 nm was controlled by varying both the quantity of emitted light and the time of emission. The scanning exposure was conducted at a pixel density of 400 dpi and an average exposure time per pixel was about $5\times10^{-8}$ second. The temperature of the semiconductor lasers used was maintained constant by means of a Peltier element in order to suppress variations of quantity of light with temperature.

While the invention has been described in detail and with reference to specific examples thereof, it will be apparent to one skilled in the art that various changes and modifications can be made therein without departing from the spirit and scope thereof.

What is claimed is:

1. A silver halide color photographic light-sensitive material comprising a support having thereon photographic constituent layers comprising at least three silver halide emulsion layers each having a spectral sensitivity different from one another and containing yellow, magenta and cyan color forming couplers, respectively and a light-insensitive hydrophilic colloid layer, wherein the cyan color forming coupler is at least one dye forming coupler represented by the formula (I) shown below, at least one of the silver halide emulsion layers containing the cyan color forming coupler contains a silver halide emulsion composed of high silver chloride content grains having a silver chloride content of 80 mol % or more, and the high silver chloride content grains are tabular silver halide grains having (100) faces as major faces:

(I)

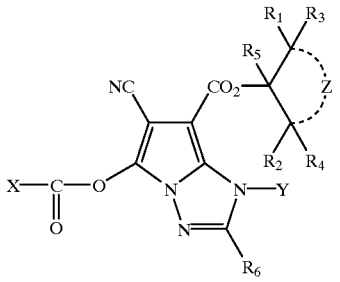

wherein $R_1$, $R_2$, $R_3$, $R_4$ and $R_5$ each represents a hydrogen atom or a substituent; Z represents a non-metallic atomic group necessary for forming a ring, which may be substituted; X represents a heterocyclic group, a substituted amino group or an aryl group; Y represents a hydrogen atom or a substituent; and $R_6$ represents a substituent.

2. The silver halide color photographic light-sensitive material as claimed in claim 1, wherein $R_1$ and $R_2$ each represents an aliphatic group and $R_3$, $R_4$ and $R_5$ each represents a hydrogen atom.

3. The silver halide color photographic light-sensitive material as claimed in claim 1, wherein the ring formed together with Z is a cyclohexane ring which may be substituted.

4. The silver halide color photographic light-sensitive material as claimed in claim 1, wherein Y represents a hydrogen atom.

5. The silver halide color photographic light-sensitive material as claimed in claim 1, wherein $R_6$ represents a phenyl group having an aliphatic group in its 4-position and X represents a heterocyclic group.

6. The silver halide color photographic light-sensitive material as claimed in claim 1, wherein the cyan coupler represented by the formula (I) is used together with a high boiling point organic solvent represented by the following formula (S):

(S)

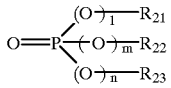

wherein $R_{21}$, $R_{22}$ and $R_{23}$ each represents an aryl group; and l, m and n each represents 1 or 0.

7. The silver halide color photographic light-sensitive material as claimed in claim 1, wherein tabular grains having (100) faces as major faces and an aspect ratio (diameter/thickness) of 1.5 or more account for 10% or more of the total projected area of silver halide grains in the silver halide emulsion layer containing high silver chloride content grains, the tabular grains have at least one gap phase discontinuous in halogen composition in the nuclear thereof, and the gap is composed of a difference of from 10 to 100 mol % in $Cl^-$ content or $Br^-$ content and/or a difference of from 5 to 100 mol % in $I^-$ content.

8. The silver halide color photographic light-sensitive material as claimed in claim 7, wherein the tabular grains have at least one gap phase discontinuous in halogen composition in the nuclei thereof, and the gap is composed of a difference of from 30 to 100 mol % in $Cl^-$ content or $Br^-$ content.

9. The silver halide color photographic light-sensitive material as claimed in claim 1, wherein the high silver chloride content grains have a silver chloride content of from 98 to 100 mol %.

10. The silver halide color photographic light-sensitive material as claimed in claim 1, wherein the color photographic light-sensitive material has a reflection density of not less than 0.3 at a wavelength of 550 nm.

11. The silver halide color photographic light-sensitive material as claimed in claim 1, wherein at least one of the photographic constituent layers contains a water-soluble dye represented by the formula (IX) shown below in a molecular dispersion state of a monomolecule or a dimer:

(IX)

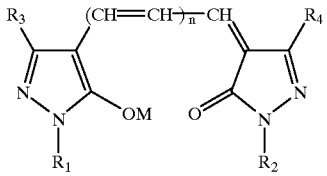

wherein $R_1$, $R_2$, $R_3$ and $R_4$ each represents a hydrogen atom or a substituent, provided that the total atomic weight of at least one of $(R_1+R_3)$ and $(R_2+R_4)$ is not more than 160; n represents 0, 1, or 2; and M represents a hydrogen atom or an alkali metal.

12. The silver halide color photographic light-sensitive material as claimed in claim 11, wherein $R_1$, $R_2$, $R_3$ and $R_4$ each has no dissociation group.

13. The silver halide color photographic light-sensitive material as claimed in claim 11, wherein $R_1$ and $R_2$ each represents a hydrogen atom or an alkyl group.

14. The silver halide color photographic light-sensitive material as claimed in claim 11, wherein the water-soluble dye is represented by the following formula (X):

(X)

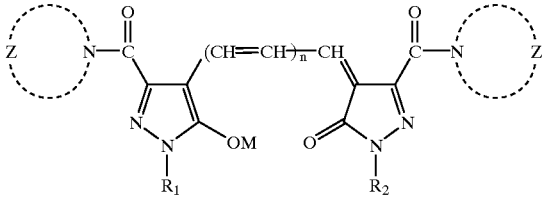

wherein $R_1$ and $R_2$ each represents a hydrogen atom or a substituent; n represents 0, 1 or 2; M represents a hydrogen atom or an alkali metal; Z represents an atomic group necessary to form a 5- or 6-membered saturated heterocyclic group together with the nitrogen atom; provided that at least one of the total atomic weight of $R_1$ and Z and the total atomic weight of $R_2$ and Z is not more than 130.

15. The silver halide color photographic light-sensitive material as claimed in claim 1, wherein the support is a reflective type support.

16. A method of forming a color image comprising subjecting a silver halide color photographic light-sensitive material to a scanning exposure system for an exposure time of not more than $10^{-4}$ second per pixel, wherein the silver halide color photographic light-sensitive material comprises a support having thereon photographic constituent layers comprising at least three silver halide emulsion layers each having a spectral sensitivity different from one another and containing yellow, magenta and cyan color forming couplers, respectively and a light-insensitive hydrophilic colloid layer, wherein the cyan color forming coupler is at least one dye forming coupler represented by the formula (I) shown below, at least one of the silver halide emulsion layers containing the cyan color forming coupler contains a silver halide emulsion composed of high silver chloride content grains having a silver chloride content of 80 mol % or more, and the high silver chloride content grains are tabular silver halide grains having (100) faces as major faces:

(I)

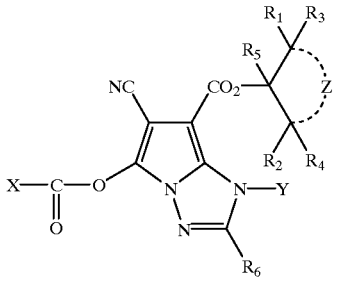

wherein $R_1$, $R_2$, $R_3$, $R_4$ and $R_5$ each represents a hydrogen atom or a substituent; Z represents a non-metallic atomic group necessary for forming a ring, which may be substituted; X represents a heterocyclic group, a substituted amino group or an aryl group; Y represents a hydrogen atom or a substituent; and $R_6$ represents a substituent.

17. The method as claimed in claims 16, wherein $R_1$ and $R_2$ each represents an aliphatic group and $R_3$, $R_4$ and $R_5$ each represents a hydrogen atom.

18. The method as claimed in claim 16 wherein the ring formed together with Z is a cyclohexane ring which may be substituted.

19. The method as claimed in claim 16, wherein Y represents a hydrogen atom.

20. The method as claimed in claim 16, wherein $R_6$ is a phenyl group substituted with an aliphatic group in its 4-position.

21. The method as claimed in claim 16, wherein $R_6$ represents a phenyl group having an aliphatic group in its 4position and X represents a heterocyclic group.

22. The method as claimed in claim 16, wherein the cyan coupler represented by the formula (I) is used together with a high boiling point organic solvent represented by the following formula (S):

(S)

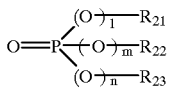

wherein $R_{21}$, $R_{22}$ and $R_{23}$ each represents an aryl group; and l, m and n each represents 1 or 0.

23. The method as claimed in claim 16, wherein tabular grains having (100) faces as major faces and an aspect ratio (diameter/thickness) of 1.5 or more account for 10% or more of the total projected area of silver halide grains in the silver halide emulsion layer containing high silver chloride content grains, the tabular grains having at least one gap phase discontinuous in halogen composition in the nuclei thereof, and the gap is composed of a difference of from 10 to 100 mol % in $C1^-$ content or $Br^-$ content and/or a difference of from 5 to 100 mol % in $I^-$ content.

24. The silver halide color photographic light-sensitive material as claimed in claim 23, wherein the tabular grains have at least one gap phase discontinuous in halogen composition in the nuclei thereof, and the gap is composed of a difference of from 30 to 100 mol % in $C1^-$ content or $Br^-$ content.

25. The method as claimed in claim 23, wherein the tabular grains have at least one gap phase discontinuous in halogen composition in the nuclei thereof, and the gap is composed of a difference of from 30 to 100 mol % in Br content.

26. The method as claimed in claim 23, wherein the tabular grains have 2 to 4 gap phases discontinuous in halogen composition in the nuclei thereof.

27. The method as claimed in claim 16, wherein the high silver chloride content grains have a silver chloride content of from 98 to 100 mol %.

28. The method as claimed in claim 16, wherein the color photographic light-sensitive material has a reflection density of not less than 0.3 at a wavelength of 550 nm.

29. The method as claimed in claim 16, wherein at least one of the photographic constituent layers contains a water-soluble dye represented by the formula (IX) shown below in a molecular dispersion state of a monomolecule or a dimer:

(IX)

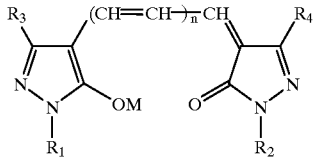

wherein $R_1$, $R_2$, $R_3$ and $R_4$ each represents a hydrogen atom or a substituent, provided that the total atomic weight of at least one of $(R_1+R_3)$ and $(R_2+R_4)$ is not more that 160; n represents 0, 1 or 2; and M represents a hydrogen atom or an alkali metal.

30. The method as claimed in claim 29, wherein $R_1$, $R_2$, $R_3$ and $R_4$ each has no dissociation group.

31. The method as claimed in claim 29, wherein $R_1$ and $R_2$ each represents a hydrogen atom or an alkyl group.

32. The method as claimed in claim 29, wherein the water-soluble dye is represented by the following formula (X):

(X)

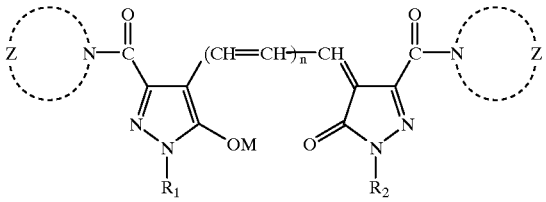

wherein $R_1$ and $R_2$ each represents a hydrogen atom or a substituent; n represents 0, 1 or 2; M represents a hydrogen atom or an alkali metal; Z represents an atomic group necessary to form a 5- or 6-membered saturated heterocyclic group together with the nitrogen atom; provided that at least one of the total atomic weight of $R_1$ and Z and the total atomic weight of $R_2$ and Z is not more than 130.

33. The method as claimed in claim 16, wherein the support is a reflective type support.

* * * * *